US011054786B2

(12) United States Patent
Hirata et al.

(10) Patent No.: US 11,054,786 B2
(45) Date of Patent: Jul. 6, 2021

(54) IMAGE FORMING APPARATUS

(71) Applicant: CANON KABUSHIKI KAISHA, Tokyo (JP)

(72) Inventors: Yuichiro Hirata, Susono (JP); Taku Watanabe, Susono (JP); Shunsuke Matsushita, Yokohama (JP); Takayoshi Kihara, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/729,935

(22) Filed: Dec. 30, 2019

(65) Prior Publication Data

US 2020/0218195 A1 Jul. 9, 2020

(30) Foreign Application Priority Data

Jan. 8, 2019 (JP) ..... JP2019-001490

(51) Int. Cl.
*G03G 21/00* (2006.01)
*G03G 15/16* (2006.01)

(52) U.S. Cl.
CPC ..... *G03G 21/0094* (2013.01); *G03G 15/1665* (2013.01); *G03G 21/0011* (2013.01)

(58) Field of Classification Search
CPC ..... G03G 21/0011; G03G 21/0094; G03G 15/0863; G03G 15/1665
See application file for complete search history.

(56) References Cited

U.S. PATENT DOCUMENTS 8,725,021 B2 * 5/2014 Matsuda ..... G03G 21/0011 399/71
2004/0141765 A1 * 7/2004 Shimura ..... G03G 15/5058 399/49
2009/0220266 A1 * 9/2009 Shiraishi ..... G03G 15/0877 399/58
2009/0245904 A1 * 10/2009 Maruyama ..... G03G 21/105 399/350

(Continued)

FOREIGN PATENT DOCUMENTS

JP H10161426 A 6/1998

*Primary Examiner* — Walter L Lindsay, Jr.
*Assistant Examiner* — Jessica L Eley
(74) *Attorney, Agent, or Firm* — Rossi, Kimms & McDowell LLP

(57) ABSTRACT

An image forming apparatus includes an image bearing member, a charging member for charging the image bearing member, an exposure unit for exposing the charged surface of the image bearing member, a developing apparatus that supplies a developer containing a toner particle and an external additive having an opposite charging polarity to the regular charging polarity of the toner particle to the image bearing member, a cleaning member for removing the developer from the image bearing member, a transfer member for transferring a developer image on the image bearing member onto a transfer subject material, and a voltage application unit for applying a voltage to the transfer member. During an image non-formation period as a lubrication operation to the cleaning member, (i) the developer is supplied to the image bearing member, and (ii) a voltage having an identical polarity to a voltage applied during the image formation operation is applied.

10 Claims, 14 Drawing Sheets

(56) References Cited

U.S. PATENT DOCUMENTS

2010/0272457 A1* 10/2010 Mabuchi ..... G03G 15/0853
399/49
2018/0003540 A1* 1/2018 Kawasaki ..... G01S 13/02

* cited by examiner

IMAGE FORMING APPARATUS

BACKGROUND OF THE INVENTION

Field of the Invention

The present invention relates to an image forming apparatus for forming an image on a recording material. The image forming apparatus may be a copier, a printer, a facsimile apparatus, a word processor, a multifunction device (a multifunction printer), or the like using an electrophotographic image forming system or an electrostatic recording system.

Description of the Related Art

Conventionally, in an image forming apparatus for forming an image on a recording medium such as recording paper, an electrostatic latent image is formed by a photosensitive member unit including a photosensitive drum serving as an image bearing member, a charging apparatus, a cleaning apparatus, and so on. Image formation is then performed by visualizing the electrostatic latent image in a developing unit that includes toner serving as a developer, a developer carrying member, and so on.

A cleaning blade that cleans the photosensitive drum by contacting the photosensitive drum and scraping off untransferred toner on the photosensitive drum is used as the cleaning apparatus. A flexible member formed from urethane rubber or the like is typically used as the cleaning blade. A cleaning blade in which conditions such as the rubber hardness, the thickness, and the modulus of elasticity have been optimized is normally used as the cleaning blade. Even so, noise and tucking-up of the blade may occur due to chatter (abnormal vibration) of the cleaning blade, which is caused by an increase in frictional resistance between the photosensitive drum and the cleaning blade.

To deal with this phenomenon, toner is supplied (referred to hereafter as a toner supply operation) to the photosensitive drum from the developing unit following image formation until the photosensitive drum stops, and the toner is used as a lubricant. It has been stated that in so doing, noise generated between the cleaning blade and the photosensitive drum and tucking-up of the cleaning blade can be prevented (see Japanese Patent Application Publication No. H10-161426).

SUMMARY OF THE INVENTION

However, when a large number of images are formed continuously, a timing for supplying the lubricant to the photosensitive drum cleaning blade does not exist, and therefore chatter (abnormal vibration) may occur in the blade, leading to the formation of vertical streaks on the image. Temporarily interrupting image formation and having the image forming apparatus perform an operation for supplying lubricant to the photosensitive drum cleaning blade is conceivable, but this leads to a reduction in productivity.

Hence, an object of the present invention is to provide an image forming apparatus with which a cleaning performance with respect to a photosensitive drum is maintained without causing a reduction in the productivity of image formation.

To achieve the object described above, an image forming apparatus according to the present invention includes the following:

a rotatable image bearing member on which an electrostatic latent image is formed;

a charging member for charging a surface of the image bearing member;

an exposure unit that forms the electrostatic latent image by exposing the surface of the image bearing member charged by the charging member;

a developing apparatus which, in order to form a developer image by developing the electrostatic latent image formed on the surface of the image bearing member, supplies a developer containing a toner particle and an external additive externally added to the toner particle, the external additive having an opposite charging polarity to a regular charging polarity of the toner particle, to the image bearing member;

a cleaning member that contacts the surface of the image bearing member in order to remove the developer from the surface of the image bearing member;

a transfer member provided facing the image bearing member in order to transfer the developer image formed on the surface of the image bearing member onto a transfer subject material; and a voltage application unit for applying a voltage to the transfer member, wherein, (i) the developing apparatus supplies the developer to the image bearing member during an image non-formation period and (ii) the voltage application unit applies a voltage having an identical polarity to a voltage applied during the image formation operation for transferring the developer image onto the transfer subject material during the image non-formation period, the image non-formation period corresponding to a timing between page-unit image formation operations and serves as a lubrication operation for supplying a lubricant to the cleaning member.

According to the present invention, as described above, it is possible to provide an image forming apparatus with which a cleaning performance with respect to a photosensitive drum is maintained without causing a reduction in the productivity of image formation.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
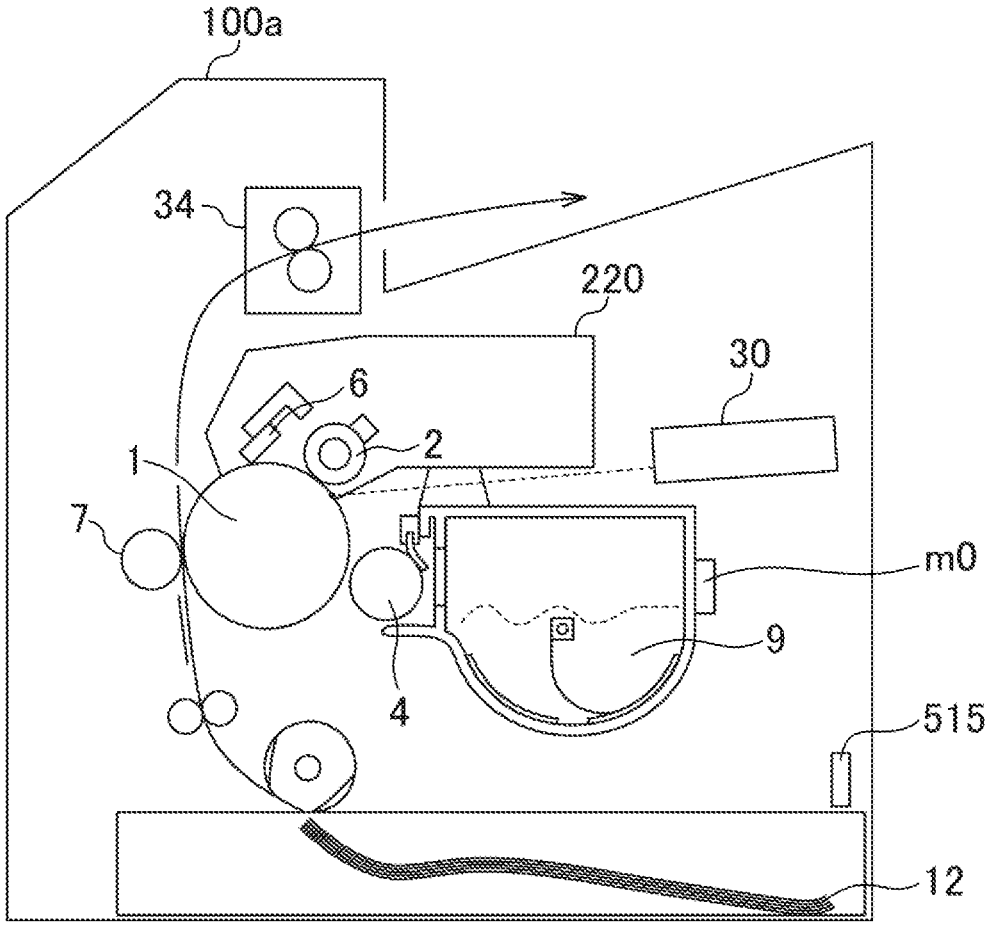
FIG. 1 is an illustrative view of an image forming apparatus according to an embodiment.

FIG. 1 shows the schematic configuration of an image forming apparatus 100*a* according to this embodiment. The image forming apparatus according to this embodiment is a monochrome laser beam printer that forms images on a recording material such as paper using an electrophotographic process.

A drum-shaped photosensitive member 1 (referred to hereafter as the photosensitive drum 1) is disposed substantially centrally in an apparatus main body M of the image forming apparatus 100*a* as an image bearing member. The photosensitive drum 1 is configured by forming an OPC (organic photoconductor) photosensitive layer on the outer peripheral surface of a conductive drum substrate made of aluminum or the like, and is driven to rotate in the direction of an arrow R1 at a predetermined process speed (peripheral speed) of 200 mm/s.

The surface (the peripheral surface) of the photosensitive drum 1 described above is evenly (uniformly) charged to a predetermined polarity/potential by a charging roller 2 serving as a charging member. The charged surface of the photosensitive drum 1 is exposed to a laser beam output from a scanner unit 30 serving as an exposure unit. The laser beam is modulated in accordance with target image information, whereby an electrostatic latent image is formed on the photosensitive drum. Note that the exposure unit for forming the electrostatic latent image is not limited to a laser diode, and an LED exposure unit, for example, may also be used. In the following description, it is assumed that a laser diode is used as the exposure unit. Returning to FIG. 1, a developing apparatus 4 serving as developing portion develops the electrostatic latent image as a toner image by applying toner 9 serving as a developer thereto. Further, a silica particle with a particle size of 20 nm and a positive particle are added to the surface of the toner particle constituting the toner 9 as a toner external additive (an external additive particle). An external additive using a metal or metal oxide with a titanium base or the like may be cited as a representative positive particle. In the present invention, negative polarity is used as the regular charging polarity of the toner particle constituting the toner 9, and a case in which negative polarity toner is used as the toner 9 will be described below. Note, however, that the toner 9 of the present invention is not limited to negative polarity toner.

A recording medium 12 is fed by a paper feeding roller and conveyed to a transfer nip between the photosensitive drum 1 and a transfer roller 7 in synchronization with the toner image drawn on the photosensitive drum 1, whereupon the toner image is transferred onto the surface thereof. At the time of transfer, a transfer bias is applied to the transfer roller 7 from a transfer bias application power supply (not shown).

After receiving transfer of the toner image, the recording medium 12 is separated from the surface of the photosensitive drum 1 and conveyed to a fixing unit 34 serving as fixing portion. Here, the toner image is fixed on the surface of the recording medium 12 by applying heat and pressure thereto. Meanwhile, following transfer of the toner image, the photosensitive drum 1 is prepared for the next image formation operation by removing the toner 9 that has not been transferred onto the recording medium 12 and remains on the surface thereof using a cleaning member 6 serving as cleaning portion.

In the image forming apparatus according to this embodiment, four process devices, namely the photosensitive drum 1, the charging roller 2, the developing apparatus 4, and the cleaning member 6, are incorporated integrally into a process cartridge 220 that can be attached to and detached from the apparatus main body M.

Outline of Lubricant Supply Operation

Figure 4:
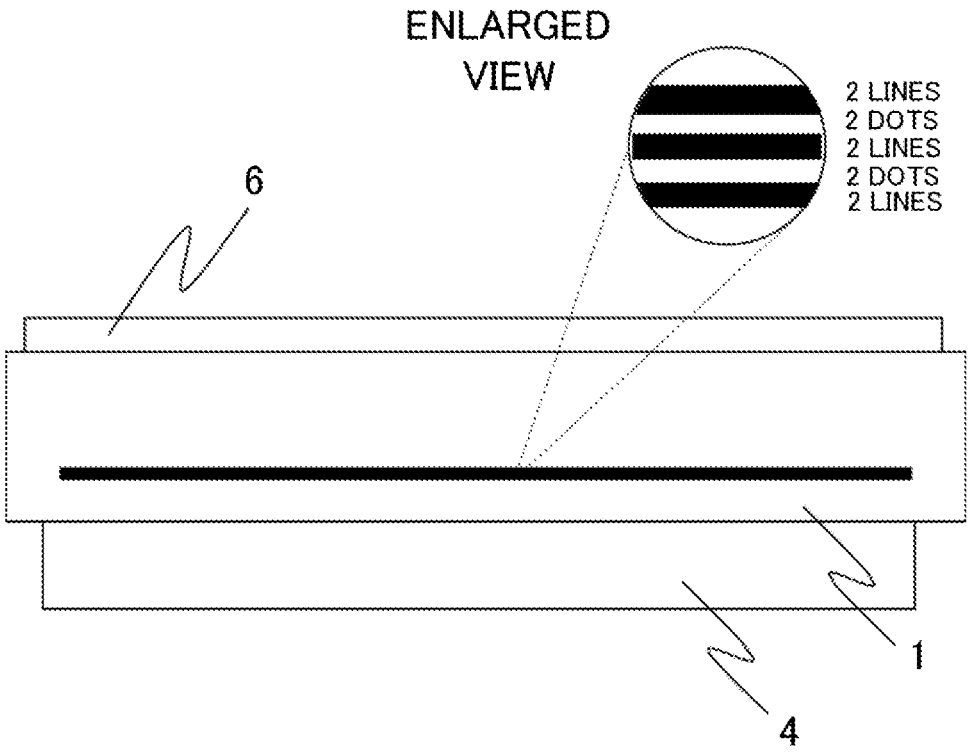
FIG. 4 is an example of a toner pattern formed in the lubricant supply operation.

A lubricant supply operation (a lubricating operation) according to the first embodiment will now be described. The lubricant supply operation is a supply operation for supplying the toner 9 to the photosensitive drum 1 from the developing roller 4. The lubricant supply operation is performed at a timing corresponding to an interval between page-unit image formation operations (between sheets), for example. The term "page-unit" denotes A4 size units, for example. Further, page unit information is acquired from received job information. More specifically, a toner image is created on the photosensitive drum 1 by performing laser exposure on a short line-form image from the scanner unit 30 serving as the exposure unit and visualizing the image using the developing roller 4. An image having a certain width, which is formed by repeatedly creating a linear image (for example, a 2 dot, 2 space image) that spreads over substantially the entire longitudinal direction region of the photosensitive drum 1 and extends in the rotation direction (the circumferential direction) of the photosensitive drum 1, may be cited as an example of the toner image. FIG. 4, to be described below, shows an example of this toner image pattern. In the first embodiment, for example, 100 linear toner images are created on the photosensitive drum 1 and the toner 9 is supplied thereto.

In a different method to that described above, a hound-stooth check-shaped latent image, for example, may be created and a toner image may be formed thereon. In other words, as long as a predetermined amount of toner can be supplied to the photosensitive drum 1, the latent image may take any form.

Conventionally, when a toner purge, or in other words the lubricant supply operation described above, is performed during continuous printing, a bias of the opposite charging polarity to the toner is applied to the transfer roller 7 while the printing is underway. When a toner purge, i.e. a lubricant supply operation, becomes necessary at this time, a large amount of toner can be left on the photosensitive drum 1 while preventing the toner from soiling the transfer roller 7 by applying a bias of an identical charging polarity to the toner to the transfer roller 7 at a timing between sheets.

By leaving a large amount of toner on the photosensitive drum 1, the toner can be fed to the cleaning member 6 on the photosensitive drum 1 as a lubricant. As a result, the cleaning member 6 can maintain a superior cleaning performance.

However, when the transfer bias is switched to the opposite polarity, a switching period of several hundred msec may be required. The reason for this is that in order to stabilize the transfer bias, a capacitor is disposed upstream, and time is required to charge and discharge the capacitor. When a switching period of several hundred msec is required between sheets in the case of a high-speed machine, since it is necessary to switch the bias between the sheets and then return the bias, the switch takes double the period of several hundred msec. In order to secure this period, a longer time than usual is required between sheets, leading to a throughput delay.

In this embodiment, to avoid this problem, the bias applied to the transfer roller 7 is not switched to the opposite polarity between sheets, i.e. during an image non-formation period. In other words, the polarity of the bias (the voltage) applied to the transfer roller 7 is identical to that of the bias applied during image formation.

However, when the toner 9 supplied onto the photosensitive drum 1 does not contain the positive external additive described above, all of the toner 9 serving as the developer is collected by the transfer roller 7, and as a result, lubricant cannot be supplied to the cleaning member 6.

Therefore, in this embodiment, a positive material is included in a part of the external additive of the toner 9, and in this state a transfer bias (a voltage) of the same polarity as that used during image formation is applied to the transfer roller 7 during the image non-formation period. Thus, when the toner 9 supplied onto the photosensitive drum 1 from the developing apparatus 4 passes the transfer roller 7, a powder (a developer) centering on the toner 9, with a charging polarity that has been charged to negative polarity due to a reduction in the amount of positive external additive, is moved onto the transfer roller 7. Correspondingly, a powder (a developer) centering on the positive external additive, which is charged to the opposite polarity to the powder centering on the toner 9, can be supplied to the photosensitive drum 1. When a powder (a developer) containing a large amount of the positive external additive is used as a lubricant for the cleaning member 6, the cleaning blade and the drum rotate smoothly, and therefore chatter can be suppressed so that the toner does not slip out from under the cleaning blade due to the chatter. As a result, a highly effective cleaning performance can be maintained.

In this embodiment, the transfer bias applied during the image non-formation period is completely identical to the bias applied during image formation, but even when a transfer bias having the opposite charging polarity to the toner is applied, control may be executed to reduce the absolute value of the transfer bias below that of the bias applied during image formation. In so doing, developer containing a large amount of the positive external additive remains on the photosensitive drum. A transfer bias at which a potential difference for ensuring that developer containing a small amount of the positive external additive moves to the transfer roller 7 is formed between the surface potential of the photosensitive drum 1 and the transfer bias applied to the transfer roller 7 may then be applied to the transfer roller 7. Thus, a transfer bias having the opposite charging polarity to the toner may be applied within a range in which the absolute value of the transfer bias is reduced below that applied during image formation without extending the interval between sheets.

Note that the toner 9 is consumed, albeit in a small amount, likewise during the lubricant supply operation (the lubricating operation) described above. Therefore, the lubricant supply operation is preferably executed at an optimum frequency. In the first embodiment, an execution interval of the lubricant supply operation is stored in a memory inside the cartridge or a ROM provided in the image forming apparatus, and the lubricant supply operation is executed using this value. The execution interval of the lubricant supply operation will now be described. When the image non-formation period is classified as either a first image non-formation period in which the lubricant supply operation is performed or a second image non-formation period in which the lubricant supply operation is not performed, the execution interval of the lubricant supply operation is determined according to the number of second image non-formation periods following the first image non-formation period and so on. For example, when image formation is performed once for every 10 sheets of recording material and the lubricant supply operation is executed in the interval between the 10th and 11th sheets of recording material, the interval between the 10th and 11th sheets of recording material corresponds to the first image non-formation period. Meanwhile, the interval between the 8th and 9th sheets of recording material, for example, corresponds to the second image non-formation period.

Block Diagram

Figure 2:
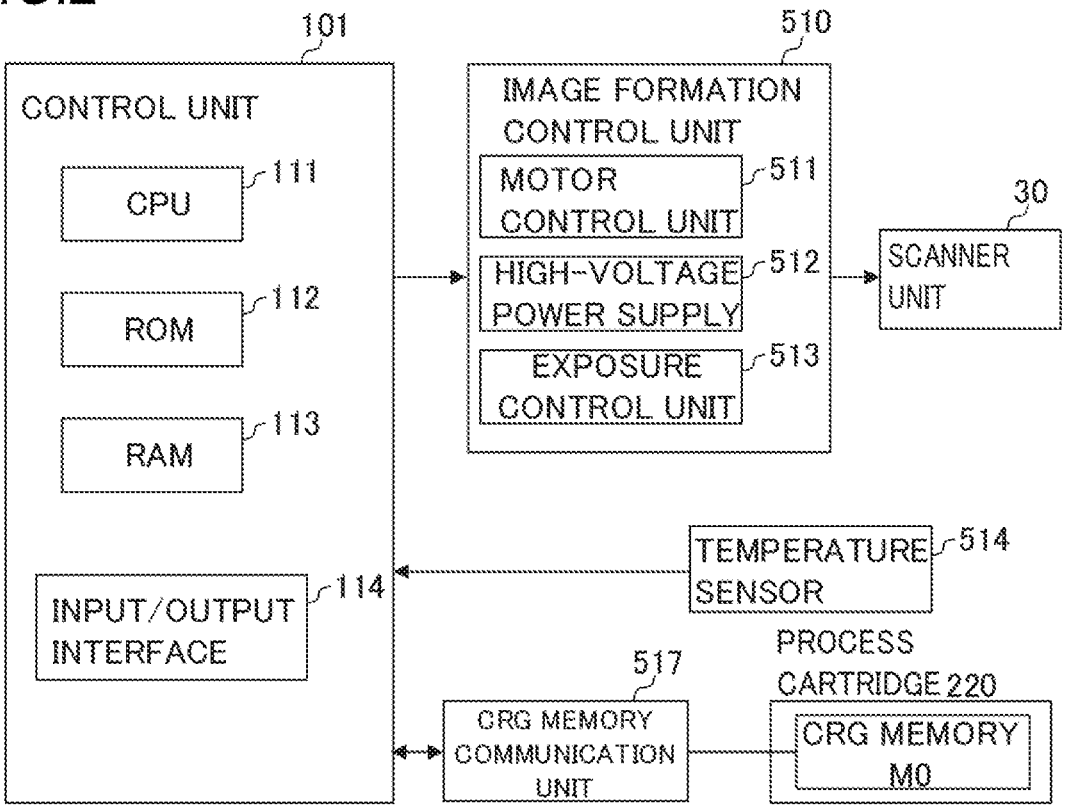
FIG. 2 is a control block diagram of the embodiment.

Next, using FIG. 2, a control configuration of the image forming apparatus 100*a* will be described. FIG. 2 is a control block diagram of the first embodiment. A control unit 101 includes a CPU (a central calculation processing unit) 111 serving as a central element for performing calculation processing, memories such as a ROM 112 and a RAM 113 serving as storage units, an input/output IF 114 for inputting and outputting information into and from a peripheral device, and so on. The CPU 111 is also known as a processor. The CPU 111 is not limited to a single processor and may have a multiprocessor configuration. The CPU 111 executes the various types of control of the control unit 101 using the ROM 112 and the RAM 113. Sensor detection results, calculation results, and so on are stored in the RAM 113. The ROM 112 is a rewritable non-volatile storage unit storing a control program, a predetermined data table, various variables, and so on.

The control unit 101 serves as control portion for performing overall control of the operations of the image forming apparatus 100*a*, and respective control subjects of the image forming apparatus 100*a* are connected thereto through the input/output I/F 114. An image formation control unit 510 controls the operations of units such as the photosensitive drum 1 and the developing apparatus 4, illustrated in FIG. 1, in response to commands from the control unit 101. The image formation control unit 510 includes a motor driving unit 511, a high-voltage power supply 512, and an exposure control unit 513, and controls the motor driving unit 511, the high-voltage power supply 512, and the exposure control unit 513. The control unit 101 may also control the motor driving unit 511, the high-voltage power supply 512, and the exposure control unit 513. Note that a configuration including the aforementioned high-voltage power supply 512 and a control unit for controlling the voltage applied to the transfer roller 7 corresponds to a voltage application unit of this embodiment.

The motor driving unit 511 is a power supply that drives a polygon scanner, the photosensitive drum 1, the developing apparatus 4, and so on, as well as various types of motors, to rotate. The motor driving unit 511 is operated on the basis of a control signal from the control unit 101 or the image formation control unit 510. The high-voltage power supply 512 applies a high voltage to the photosensitive drum 1, the charging roller 2, the developing roller 4, the transfer roller 7, the fixing apparatus 34, and so on. The exposure control unit 513 transmits a signal indicating the light amount of the laser beam 35 emitted onto the photosensitive drum 1 to the scanner unit 30.

An environment sensor 515 is provided in the image forming apparatus 100 to measure the temperature and humidity thereof, and the environment sensor 515 transmits data relating to the temperature and humidity to the control unit 101. Further, data communication between the control unit 101 and a CRG memory m0 is performed through a CRG memory communication unit 517.

The control unit 101 reads a lubricant supply operation execution timing N stored in the CRG memory m0 and controls a supply interval of the toner 9 supplied to the photosensitive drum 1 from the developing roller 4, or in other words the execution interval of the lubricant supply operation. The control unit 101 also controls the transmission and reception of various electric information signals, the timing of the supply operation, and so on, and also administers flowchart processing to be described below and so on.

Execution Processes of Lubricant Supply Operation

Figure 3:
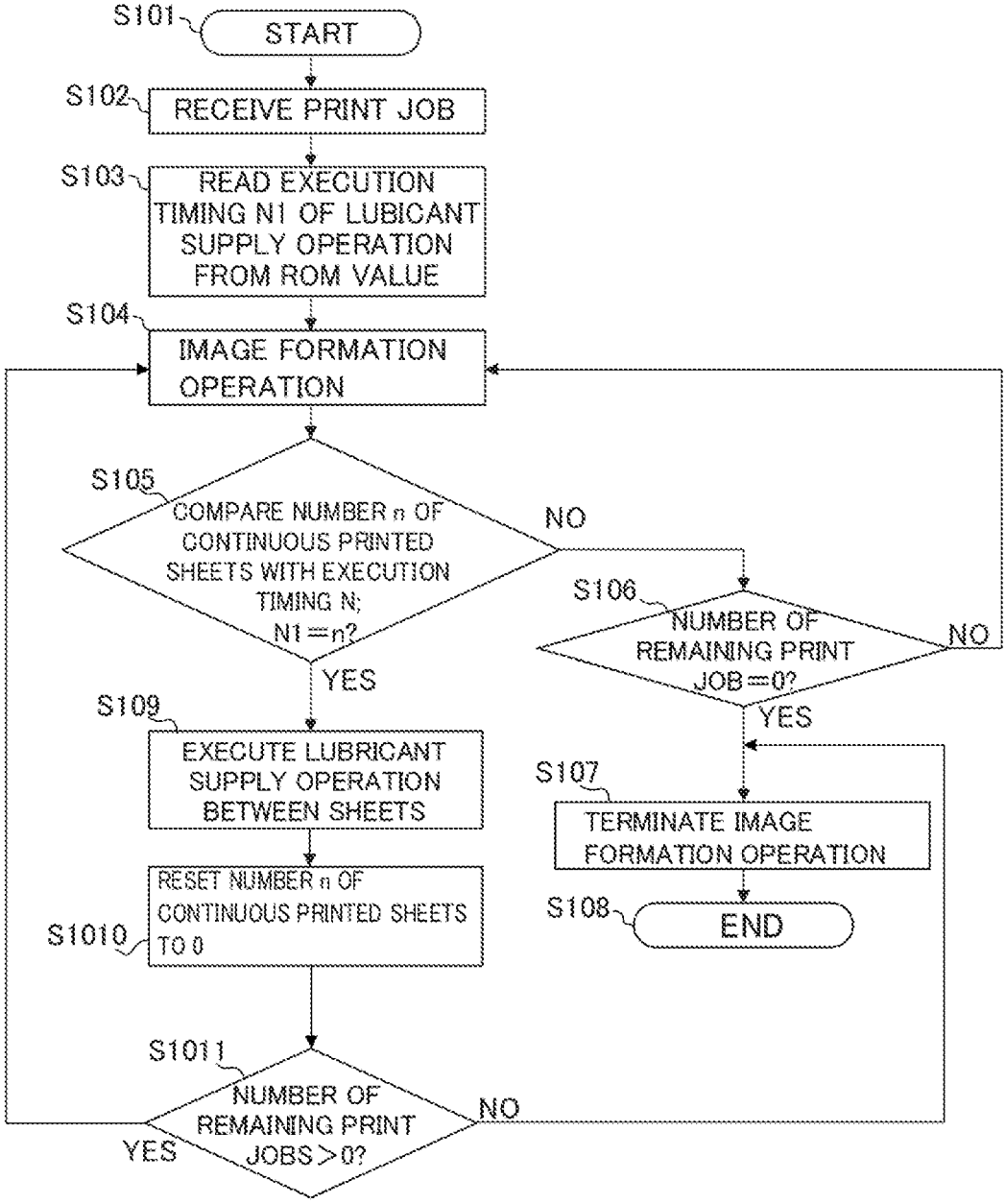
FIG. 3 is a flowchart for executing a lubricant supply operation according to a first embodiment.

Processes up to execution of the lubricant supply operation according to the first embodiment will now be described using a flowchart shown in FIG. 3.

In the first embodiment, the execution interval of the lubricant supply operation is determined on the basis of the execution timing of the lubricant supply operation, which is stored in the CRG memory m0 of the process cartridge 220, whereupon the lubricant supply operation is executed. When the image forming apparatus 100*a* enters an operable state after a power supply of the image forming apparatus 100*a* is switched ON or a cartridge exchange door is opened and closed, the flow shown in FIG. 3 is started (S101). First, the control unit 101 of the image forming apparatus receives, via an external interface 102, a print job transmitted from a host device over a communication line (S102). Next, the control unit 101 acquires information indicating the execution interval of the lubricant supply operation from the CRG memory m0 via the CRG memory communication unit 517 (S103). Next, the image forming operation is started (S104).

Once continuous printing has begun, the control unit 101 counts a number n of continuously printed sheets every time a sheet is printed and determines whether the number n matches an execution interval N1 (S105). Note that the term "every time a sheet is printed" denotes a number of surfaces, and therefore, in the case of double-sided printing, in which images are formed on both surfaces of a single sheet of paper, the number of counted sheets is 2.

When N1≠n, the control unit 101 checks whether or not the number of remaining print jobs=0 (S106). When the number of remaining print jobs=0, the control unit 101 controls the image formation control unit 510 to terminate the image formation operation (S107). The processing then advances to S108, which is the end of the flowchart.

When, on the other hand, the number of remaining print jobs≠0 in S106, the control unit 101 controls the image formation control unit 510 in order to start the next image formation operation (S104).

Returning to S105, when N1=n, the control unit 101 controls the image formation control unit 510 to execute the lubricant supply operation between sheets (S109). FIG. 4 shows an example of the toner image pattern formed on the photosensitive drum in the lubricant supply operation.

Next, the control unit 101 resets the value of the number n of continuous printed sheets to 0 (S1010) and then advances the processing to step S1011. In step S1011, the control unit 101 checks whether or not the number of remaining print jobs>0.

When the number of remaining print jobs>0, the control unit 101 advances the processing to the next image formation operation (S104). When, on the other hand, number of remaining print jobs>0 is not established, or in other words when the number of the number of remaining print jobs is zero, the image formation operation is terminated (S107).

This embodiment is not limited to a system in which transfer is performed directly from the photosensitive drum 1 onto the recording medium 12 such as a recording material, which serves as a transfer subject material, and may also be used by an image forming apparatus that uses an intermediate transfer member as the transfer subject material.

Second Embodiment

Next, a second embodiment of the present invention will be described. Note that description of parts already described in the first embodiment has been omitted.

In an image forming apparatus 100*b* according to the second embodiment, a lubricant supply amount limit is set as a limit amount at which the toner discharged in the lubricant supply operation is not transferred onto the recording medium 12.

Overall Configuration of Image Forming Apparatus

First, the overall configuration of the electrophotographic image forming apparatus (the image forming apparatus) according to this embodiment will be described.

Figure 5:
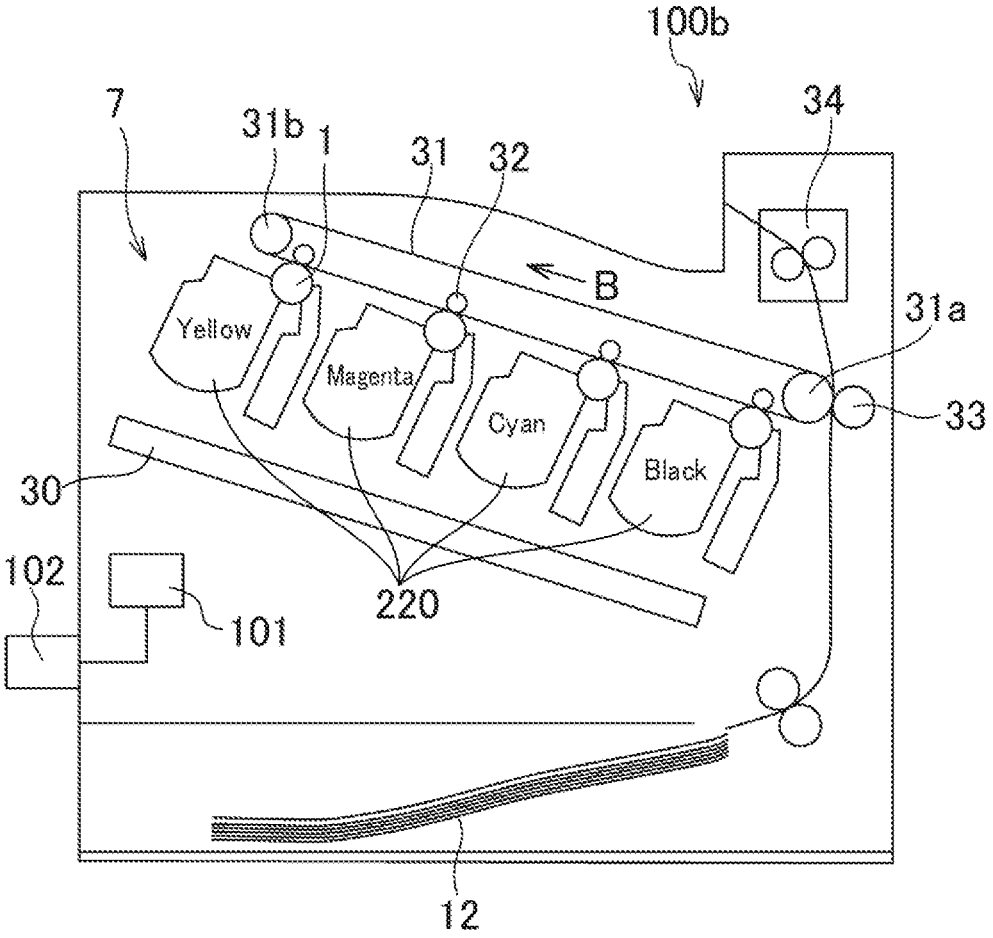
FIG. 5 is an illustrative view of an image forming apparatus according to second and third embodiments.

FIG. 5 is a schematic cross-section of the image forming apparatus 100*b* according to this embodiment. The image forming apparatus 100*b* according to this embodiment is a full-color laser printer using an inline system and an intermediate transfer system. The image forming apparatus 100*b* is capable of forming a full-color image on the recording medium 12 (for example, recording paper, a plastic sheet, fabric, and so on) in accordance with input image information. Further, the image forming apparatus 100*b* includes the control unit 101. The control unit 101 performs overall control of the image forming apparatus 100*b* and acquires various information from the host device via the external interface 102.

The input image information is processed by the control unit 101, whereupon the control unit 101 executes image formation by controlling respective means to be described below. The control unit 101 is a processor such as a CPU but may also be a specially designed circuit or the like.

The image forming apparatus 100*b* includes a plurality of, namely first to fourth, image forming units (image forming stations) SY, SM, SC, SK for forming color images in yellow (Y), magenta (M), cyan (C), and black (K), respectively. In this embodiment, the first to fourth image forming units SY, SM, SC, SK are arranged in a line in a direction intersecting a vertical direction.

Note that in this embodiment, the configurations and operations of the first to fourth image forming units SY, SM, SC, SK are substantially identical, except for the colors of the images formed thereby. In the following description, therefore, in cases where there is no particular need to distinguish therebetween, the affixes Y, M, C, K added to reference symbols to denote the color for which the element is provided have been omitted.

In this embodiment, the process cartridges 220 for the respective colors are all formed in the same shape. Toner of the respective colors, i.e. yellow (Y), magenta (M), cyan (C), and black (K), is housed in the respective process cartridges 220.

The photosensitive drum 1 is a rotatable image bearing member that is driven to rotate by driving portion (a drive source). The scanner unit (the exposure apparatus) 30 is disposed on the periphery of the photosensitive drum 1. The scanner unit 30 is an exposure unit for forming an electrostatic image (an electrostatic latent image) on the photosensitive drum 1 by emitting a laser on the basis of the image information. In a main scanning direction (an orthogonal direction to the conveyance direction of the recording medium 12), laser exposure writing on each scanning line is implemented from a position signal in a polygon scanner known as BD (Beam Detect). In a sub-scanning direction (the conveyance direction of the recording medium 12), meanwhile, laser exposure writing on each scanning line is implemented at a delay of a predetermined time from a TOP (top of paper) signal generated by a switch (not shown) provided on the conveyance path of the recording medium 12. As a result, laser exposure can be performed in identical positions on the photosensitive drums 1 at all times in the four image forming units SY, SM, SC, SK.

An intermediate transfer belt 31 serving as an example of the transfer subject material is disposed facing the four photosensitive drums 1 as an intermediate transfer member for transferring the toner images (developer images) on the photosensitive drums 1 onto the recording medium 12. The intermediate transfer belt 31, which is formed from an endless belt serving as the intermediate transfer member, contacts all of the photosensitive drums 1 and performs a circulatory motion (rotates) in the direction of an arrow B (a counterclockwise direction) shown in FIG. 1. The intermediate transfer belt 31 is wound around a drive roller 31*a* and a driven roller 31*b* serving as a plurality of support members. Four primary transfer rollers 32 are arranged on the inner peripheral surface side of the intermediate transfer belt 31 respectively facing the photosensitive drums 1 as primary transfer members. A bias having the opposite polarity to the regular charging polarity of the toner is applied to the primary transfer rollers 32 from a primary transfer bias power supply (a high-voltage power supply) serving as primary transfer bias applying portion, not shown in the figure. As a result, the toner images on the photosensitive drums 1 are transferred (subjected to primary transfer) onto the intermediate transfer belt 31.

Further, a secondary transfer roller 33 is disposed on the outer peripheral surface side of the intermediate transfer belt 31 as a secondary transfer member. A bias having the opposite polarity to the regular charging polarity of the toner is applied to the secondary transfer roller 33 from a secondary transfer bias power supply (a high-voltage power supply) serving as secondary transfer bias applying portion, not shown in the figure. As a result, the toner images on the intermediate transfer belt 31 are transferred (subjected to secondary transfer) onto the recording medium 12. During formation of a full-color image, for example, the processes described above are performed in sequence in the image forming units SY, SM, SC, SK, whereby the toner images in the respective colors are subjected to primary transfer so as to be overlapped in sequence on the intermediate transfer belt 31. Next, the recording medium 12 is conveyed to a secondary transfer section in synchronization with the movement of the intermediate transfer belt 31. Then, by the action of the secondary transfer roller 33, which contacts the intermediate transfer belt 31 through the recording medium 12, the four color toner images on the intermediate transfer belt 31 are transferred all at once, by secondary transfer, onto the recording medium 12. The recording medium 12 with the toner image transferred thereon is then conveyed to the fixing apparatus 34 serving as the fixing portion. In the fixing apparatus 34, heat and pressure are applied to the recording medium 12, whereby the toner image is fixed onto the recording medium 12.

Configuration of Process Cartridge

Next, the configuration of the process cartridge 220 attached to the image forming apparatus 100*b* according to this embodiment will be described in detail. In this embodiment, the configurations and operations of the process cartridges 220 of the respective colors are substantially identical, except for the type (color) of the toner housed therein.

Figure 6:
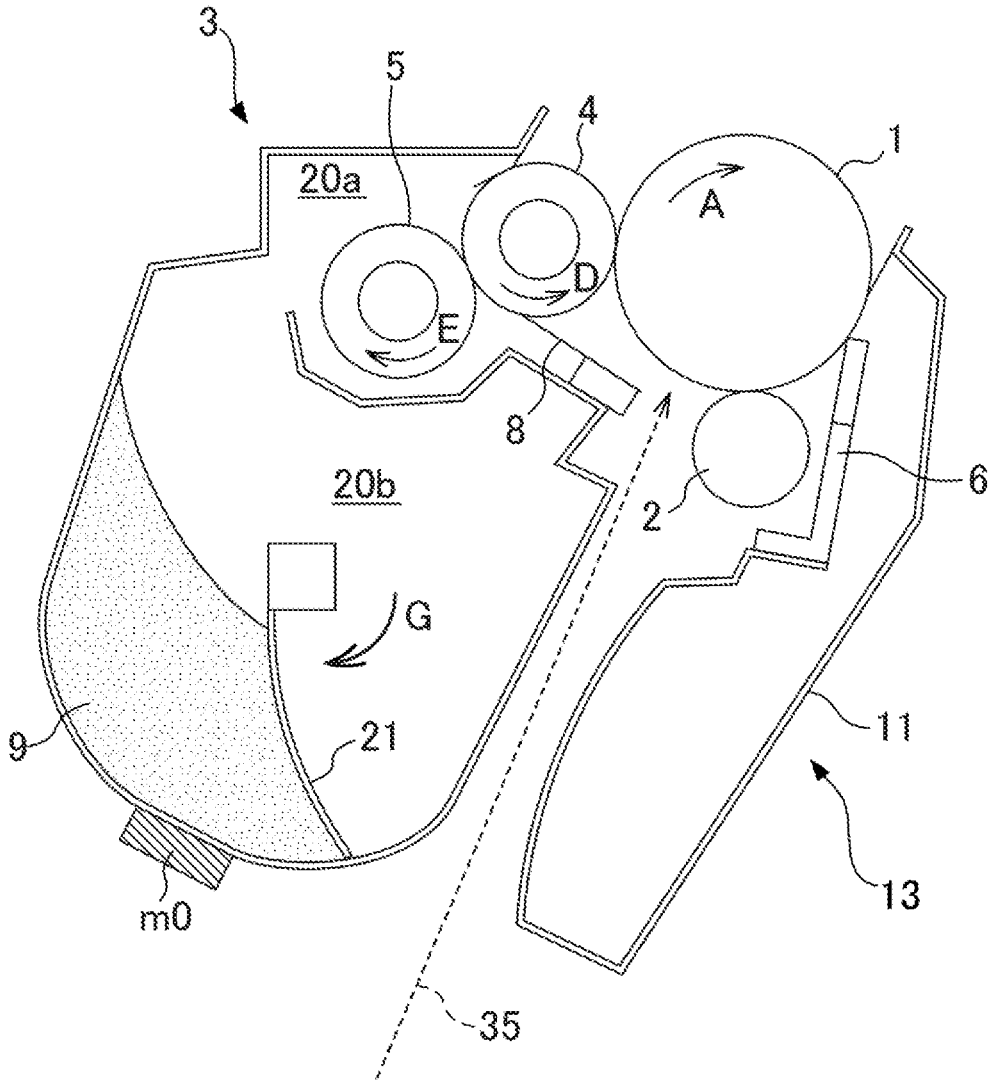
FIG. 6 is an illustrative view of a process cartridge according to the second and third embodiments.

FIG. 6 is a schematic sectional view of the process cartridge 220 according to this embodiment, seen in a longitudinal direction (a rotary axis direction) of the photosensitive drum 1. The attitude of the process cartridge 220 shown in FIG. 6 is the attitude thereof when attached to the image forming apparatus, and when positional relationships, directions, and so on of the respective members of the process cartridge are described below, this attitude will be used as a reference.

The process cartridge 220 is formed by integrating a photosensitive member unit 13 including the photosensitive drum 1 and so on, and the developing unit 3 including the developing roller 4 and so on.

The photosensitive drum 1 is attached to the photosensitive member unit 13 to be capable of rotating about a bearing, not shown in the figure. When the driving force of a drive motor, not shown in the figure, is transmitted to the photosensitive member unit 13, the photosensitive drum 1 is driven to rotate in the direction of an arrow A (a clockwise direction) in accordance with the image formation operation. An outer diameter of the photosensitive drum 1 is 30 mm, and the photosensitive drum 1 rotates at 130 rpm (204 mm/sec).

Further, the charging roller 2 and a cleaning blade 6 serving as a cleaning member (a contact member) formed from an elastic member are disposed in the photosensitive member unit 13 so as to contact the surface of the rotating photosensitive drum 1. A sufficient bias for carrying a desired charge on the photosensitive drum 1 is applied to the charging roller 2 from a charging bias power supply (a high-voltage power supply) serving as charging bias applying portion, not shown in the figure. In the second embodiment, the applied bias is set so that the potential (the charging potential: Vd) on the photosensitive drum 1 is −500 V. The laser beam 35 is emitted from the scanner unit 30 on the basis of the image information, whereby an electrostatic image (an electrostatic latent image) is formed on the photosensitive drum 1.

In the cleaning blade 6, a rubber blade 6*a* is supported by a cleaning support sheet metal 6*b*, and the rubber blade 6*a* and the cleaning support sheet metal 6*b* are formed integrally. The rubber blade 6*a* uses urethane rubber with a thickness of 2 mm and an MD-1 hardness in a 23° C. environment of 60 to 80°, for example. The cleaning blade 6 is fixed to a drum cartridge frame 11, and the tip end of the rubber blade 6*a* is disposed so as to contact the photosensitive drum 1. The cleaning blade 6 removes residual toner that has not been transferred onto the intermediate transfer belt 31 from the surface of the photosensitive drum 1 by scraping off the toner using the tip end of the free end of the rubber blade 6*a*.

The developing unit 3 includes the developing roller 4 (the developer carrying member) for carrying the toner 9, a developing chamber 20*a* in which a supply roller 5 for coating the developing roller 4 with the toner 9 is disposed, and a developer housing chamber 20*b* disposed below the supply roller 5 in the vertical direction.

The supply roller 5 rotates while forming a toner nip portion (a part where the toner is nipped between the developing roller 4 and the supply roller 5) with the developing roller 4.

A stirring conveyance member 22 is provided in the developer housing chamber 20*b*. The stirring conveyance member 22 is a member for stirring the toner housed in the developer housing chamber 20*b* and conveying the toner in the direction of an arrow G in the figure toward the upper portion of the supply roller 5. In this embodiment, the stirring conveyance member is driven to rotate at 85 rpm.

Figure 7:
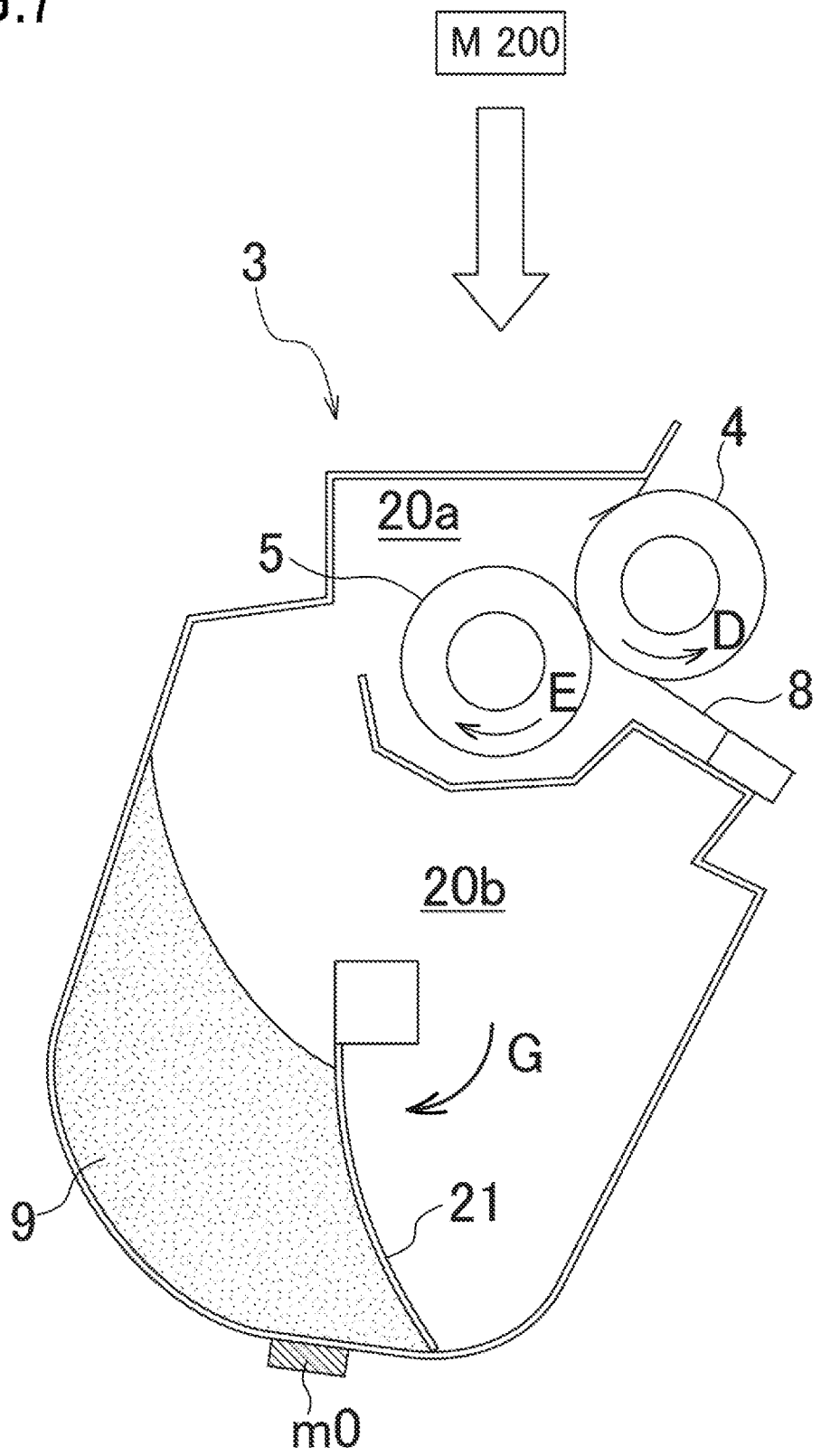
FIG. 7 is an illustrative view of a developing unit according to the second and third embodiments.

Next, the configuration of the developing unit 3 attached to the image forming apparatus according to this embodiment will be described. FIG. 7 is a sectional view (a main sectional view) of the developing unit 3 according to the present invention, seen in a longitudinal direction (a rotary axis direction) of the developing roller 4. The developing unit 3 is constituted by the developing chamber 20*a* and the developer housing chamber 20*b*, the developer housing chamber 20*b* being disposed below the developing chamber 20*a* in the vertical direction. The toner 9 serving as the developer is housed in the developer housing chamber 20*b*. The toner 9 is constituted by a toner particle and a toner external additive (an external additive particle) externally added to the surface of the toner particle. A silica particle with a particle size of 20 nm and a similar positive particle to that of the first embodiment are added to the toner particle as the toner external additive. In the present invention, negative polarity is used as the regular charging polarity of the toner 9, and a case in which negatively charged toner is used as the toner 9 will be described below. Note, however, that the toner 9 of the present invention is not limited to negatively charged toner. Further, a developer conveyance member 21 for conveying the toner 9 to the developing chamber 20*a* is provided in the developer housing chamber 20*b*, and when the developer conveyance member 21 rotates in the direction of an arrow G in FIG. 7, the toner 9 is conveyed to the developing chamber 20*a*.

The developing roller 4 is provided in the developing chamber 20*a* as a developer carrying member that contacts the photosensitive drum 1 and rotates in the direction of an arrow D in FIG. 7 upon reception of driving force from a drive motor M200 serving as developing driving portion. In the second embodiment, the developing roller 4 and the photosensitive drum 1 rotate such that in the opposing portions (the contacting portions) thereof, the respective surfaces thereof move in the same direction, and the developing roller 4 rotates at a speed of 150% relative to the rotation speed of the photosensitive drum 1. A sufficient bias to develop and visualize the electrostatic latent image on the photosensitive drum 1 as a toner image is applied to the developing roller 4 from a developing bias power supply (a high-voltage power supply) serving as a developing bias applying portion, not shown in the figure. The toner supply roller (referred to hereafter as the "supply roller") 5 for supplying the toner 9 conveyed from the developer housing chamber 20*b* to the developing roller 4 is disposed in the developing chamber 20*a*. Further, a toner amount regulating member 8 for regulating the amount of toner 9 that is coated onto the developing roller 4 after being supplied by the supply roller 5 and applying a charge to the toner 9 is also disposed in the developing chamber 20*a*.

A nonvolatile memory (referred to as a "CRG memory" hereafter) m0 (a first storage unit) is provided in the process cartridge 220 as a memory. Information corresponding to the use amount of the process cartridge 220 is stored in the CRG memory m0. The use amount of the process cartridge 220 is broadly divided into two use amounts, namely the use amount of the photosensitive member unit 13 and the use amount of the developing unit 3.

First, the information corresponding to the use amount of the photosensitive member unit 13 will be described.

The information corresponding to the use amount of the photosensitive member unit 13 may include information relating to an operation amount such as the cumulative number of rotations of the photosensitive drum 1 serving as the image bearing member and information relating to the cumulative rotation time of the photosensitive drum 1. The information corresponding to the use amount of the photosensitive member unit 13 may also be a value obtained by dividing the cumulative number of rotations or the cumulative rotation time of the photosensitive drum 1 by a first predetermined value relating to the photosensitive drum 1. Here, the first predetermined value relating to the photosensitive drum 1 is a number of rotations or a rotation time of the photosensitive drum 1 and a value set on the basis of the lifespan of the photosensitive drum 1. The information corresponding to the use amount of the photosensitive member unit 13 may also be a value obtained by subtracting the cumulative number of rotations or the cumulative rotation time of the photosensitive drum 1 from the first predetermined value relating to the photosensitive drum 1.

Next, the information corresponding to the use amount of the developing unit 3 will be described.

The information corresponding to the use amount of the developing unit 3 serving as the developing apparatus may include information such as the cumulative number of rotations of the developing roller 4, the cumulative rotation time of the developing roller 4, the toner use amount, and the remaining toner amount. The toner use amount is the amount of used toner 9, of the toner 9 housed in the developing unit 3 as the developer. The remaining toner amount is the amount of remaining toner 9, of the toner 9 housed in the developing unit 3 as the developer. The toner use amount may be determined by subtracting the remaining toner amount from the amount of toner in the developing unit 3 prior to the start of use. Further, the remaining toner amount may be determined by subtracting the toner use amount from the amount of toner in the developing unit 3 prior to the start of use. The information corresponding to the use amount of the developing unit 3 may also be a value obtained by dividing the cumulative number of rotations or the cumulative rotation time of the developing roller 4 by a second predetermined value relating to the developing roller 4. Here, the second predetermined value relating to the developing roller 4 is a number of rotations or a rotation time of the developing roller 4 and a value set on the basis of the lifespan of the developing roller 4. The information corresponding to the use amount of the developing unit 3 may also be a value obtained by dividing the toner use amount by the amount of toner in the developing cartridge 200 prior to the start of use. The information corresponding to the use amount of the developing unit 3 may also be a value obtained by dividing the remaining toner amount by the amount of toner in the developing unit 3 prior to the start of use.

The control unit 101 is capable of acquiring an amount relating to use, such as the extent to which the photosensitive member unit 13 and the developing unit 3 have been used or operated, on the basis of the information stored in the CRG memory m0. Further, information (serial numbers, models, and so on) from which the types of the photosensitive member unit 13 and the developing unit 3 can be specified is stored in the CRG memory m0. Note that the CRG memory m0 is configured to be capable of communicating (writing and reading information) with the control unit 101 of the image forming apparatus 100 shown in FIG. 1 either without contact or by contact through an electrical contact. Therefore, even when the process cartridge 220 is temporarily detached from and then reattached to the apparatus main body of the image forming apparatus 100, the control unit 101 can acquire the information corresponding to the use amounts of the photosensitive member unit 13 and the developing unit 3.

Outline of Lubricant Supply Operation

Similarly to the first embodiment, a linear toner image is created on the photosensitive drum 1 between sheets during continuous printing without switching the bias applied to the primary transfer roller 10 to the opposite polarity, whereupon a transfer bias having the same polarity as that used during image formation is applied to the primary transfer roller 10. Accordingly, within the toner image created on the photosensitive drum 1, the toner charged to negative polarity, in which the amount of positive external additive has decreased, moves onto the intermediate transfer belt on the primary transfer roller 10 side, while the toner charged to the opposite polarity to negative polarity, in which the amount of positive external additive has increased, remains on the photosensitive drum 1. By supplying the positive external additive contained in the toner as a lubricant for the cleaning member 12 in this manner, a superior cleaning performance can be maintained.

As shown in FIG. 5, four process cartridges 220 are provided, and the lubricant supply operation is executed on the process cartridges Y, M, C, K in order from the upstream side, on which the period between sheets arrives earlier.

As described above, a bias having the same polarity as that used during image formation is applied as is as the bias applied to the primary transfer roller during the lubricant supply operation executed in each station. At this time, a lot of the toner is transferred onto the intermediate transfer member 30. Similarly to the primary transfer roller, there is no time to switch the bias in the secondary transfer roller, and therefore the next image formation operation is started in a state where a bias having the same polarity as that used during image formation is applied to the secondary transfer roller.

Lubricant Supply Amount Limit

A limit amount of the toner that can be supplied without transferring toner onto the recording medium 12 during a single execution of the lubricant supply operation must be predetermined in advance as the amount of toner that can be supplied to the photosensitive drum 1 during continuous printing. Hence, in this embodiment, when the level of soil (marking) on back surface of the paper was checked in a case where a 2 dot 2 space pattern was handled as a single line and a purge, or in other words the lubricant supply operation, was executed every 3 pages, the results shown below on Table 1 were acquired.

TABLE 1

| | Number of lines | Soil on back surface of the paper |
|---|---|---|
| Purge amount 1 | 16 | No soil |
| Purge amount 2 | 60 | No soil |
| Purge amount 3 | 120 | No soil |
| Purge amount 4 | 180 | Soil |

In this embodiment, in view of these results, 120 lines is set as the lubricant supply amount limit. In this embodiment, the lubricant supply amount limit is divided into four equal parts so that the image forming stations constituted by the four process cartridges execute the lubricant supply operation every 30 lines. In so doing, it is possible to provide an image forming apparatus with which soil on back surface of the paper does not occur even when a lubricant supply operation is executed during continuous printing.

Further, in this embodiment, the purge amount was adjusted according to the number of lines, but a purge may also be performed by forming an image pattern that is difficult for humans to see.

Block Diagram

Figure 8:
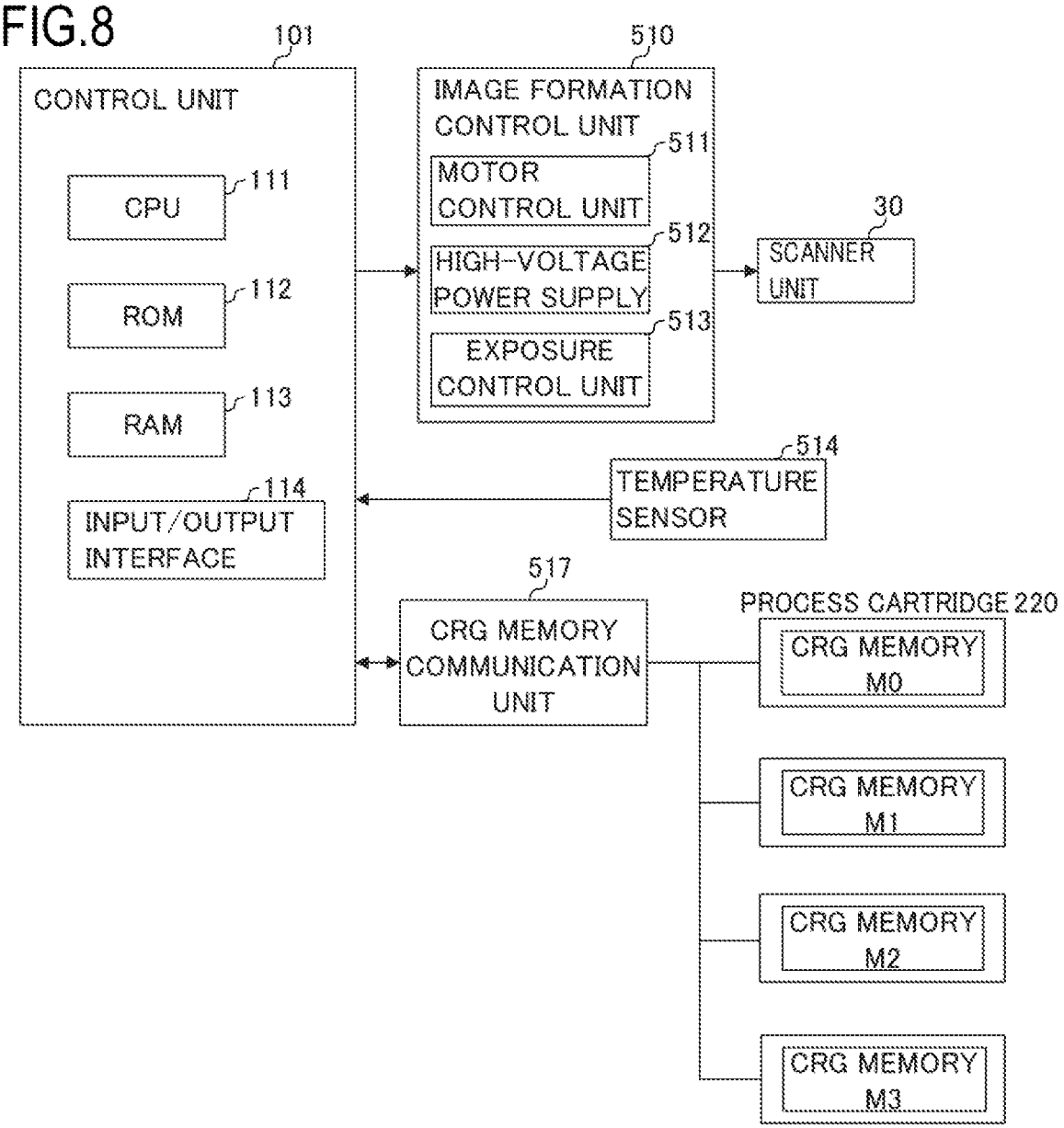
FIG. 8 is a control block diagram of the second embodiment.

Next, using FIG. 8, a control configuration of the image forming apparatus 100*b* will be described. Configurations other than those relating to the CRG memory communication unit 517 are as shown in FIG. 2, and therefore detailed description of these parts has been omitted. Here, only configurations relating to the CRG memory communication unit 517 will be described. In the first embodiment, the CRG memory communication unit 517 communicates only with the CRG memory m0. In the second embodiment, on the other hand, the process cartridge 220 of each color includes a CRG memory, and the CRG memory communication unit 517 communicates with respective CRM memories MO to M3 in order to acquire the required information. The control unit 101 counts the cumulative number of printed sheets following the start of use of the drum cartridge 210, the cumulative number of printed sheets following the start of use of the developing cartridge 200, and the cumulative number of printed sheets following the toner supply process, and stores the counted values of the cumulative numbers of printed sheets in the RAM 113. Counted values of the cumulative numbers of printed sheets may be stored in the RAM 113 in relation to each of the image forming units SY, SM, SC, SK.

Execution Processes of Lubricant Supply Operation

Figure 9:
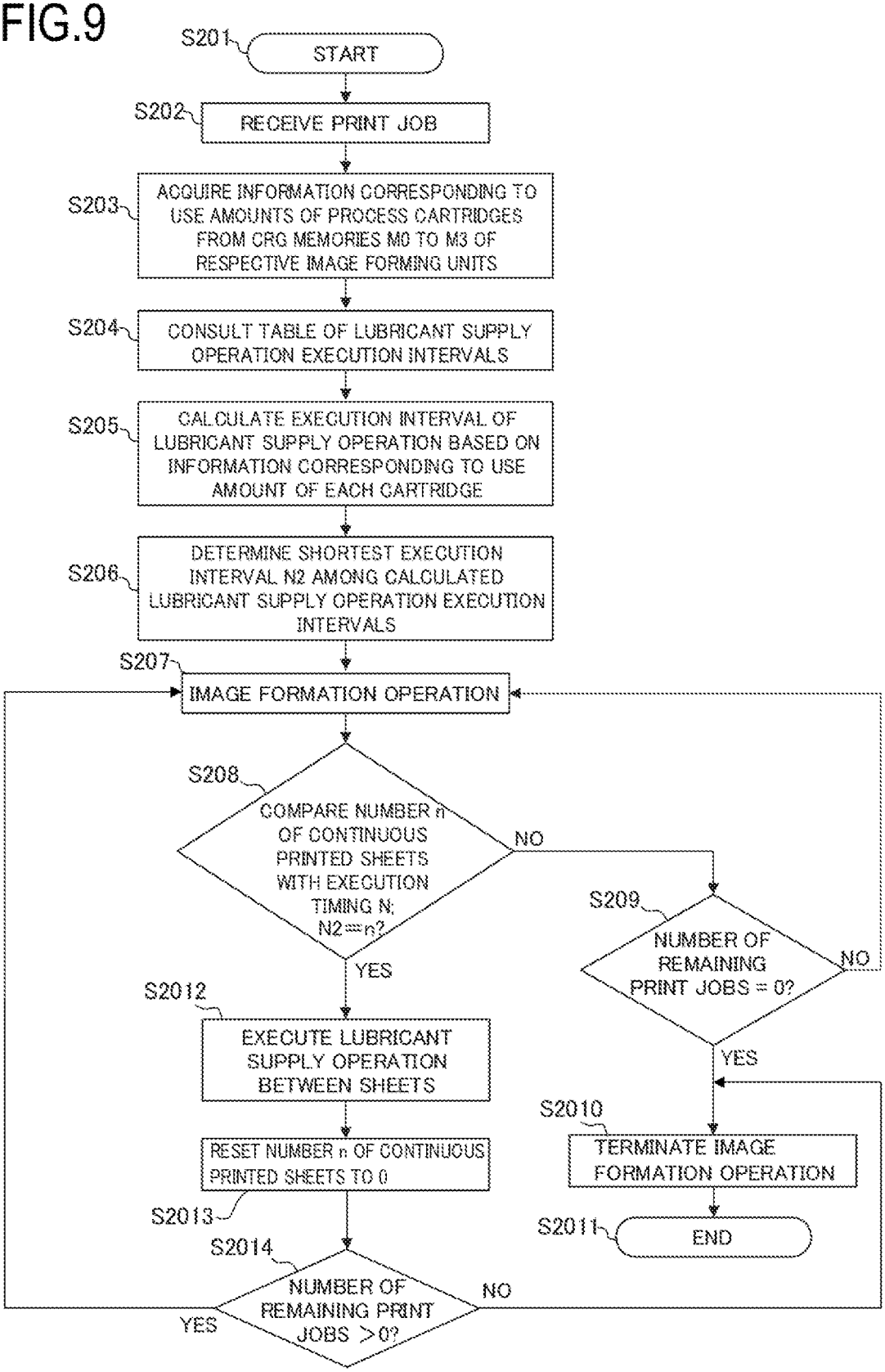
FIG. 9 is a flowchart for executing the lubricant supply operation according to the second and third embodiments.

Processes up to execution of the toner supply process according to the second embodiment will now be described using a flowchart shown in FIG. 9. When the image forming apparatus 100*b* enters an operable state after a power supply of the image forming apparatus 100*b* is switched ON or a cartridge exchange door is opened and closed, the flow shown in FIG. 9 is started (S201). First, the control unit 101 of the image forming apparatus receives, via the external interface 102, a print job transmitted from the host device over a communication line (S202). Next, the control unit 101 communicates with the CRG memories MO to M3 installed in the process cartridges 220 via the CRG memory communication unit 517. As a result, the information corresponding to the use amount of the photosensitive member unit 13 and the use amount of the developing unit 3 is acquired from the CRG memories MO to M3 of the respective image forming units SY, SM, SC, SK (S203).

Next, the control unit 101 reads and consults a table of execution intervals (numbers of printed sheets) of the lubricant supply operation from the ROM 112 (S204). The control unit 101 determines (calculates) the execution interval of the toner supply process individually for each of the image forming units SY, SM, SC, SK (S205). The control unit 101 then determines the shortest execution interval N2 among the execution intervals of the toner supply process, calculated for each of the image forming units SY, SM, SC, SK (S206).

Next, the image formation operation is started (S207). Once continuous printing has begun, the control unit 101 counts the number n of continuously printed sheets every time a sheet is printed and determines whether the number n matches the execution interval N2 (S208). Note that the term "every time a sheet is printed", similarly to the first embodiment, denotes a number of printed surfaces, and therefore, in the case of double-sided printing, in which images are formed on both surfaces of a single sheet of paper, the number of counted sheets is 2.

When N2≠n, the control unit 101 checks whether or not the number of remaining print jobs=0 (S209). When the number of remaining print jobs=0, the control unit 101 controls the image formation control unit 510 to terminate the image formation operation (S2010). The processing then advances to S2011, which is the end of the flowchart.

When, on the other hand, the number of remaining print jobs≠0 in S209, the control unit 101 controls the image formation control unit 510 in order to start the next image formation operation (S207). Returning to S208, when N2=n, the control unit 101 controls the image formation control unit 510 to execute the lubricant supply operation between sheets (S2012). The pattern of the toner image formed on the photosensitive drum 1 of each cartridge by the lubricant supply operation is similar to the first embodiment.

Next, the control unit 101 resets the value of the number n of continuous printed sheets to 0 (S2013) and then advances the processing to step S2014. In step S2014, the control unit 101 checks whether or not the number of remaining print jobs>0.

When the number of remaining print jobs>0, the control unit 101 advances the processing to the next image formation operation (S207).

When, on the other hand, number of remaining print jobs>0 is not established, or in other words when the number of the number of remaining print jobs is zero, the image formation operation is terminated (S2010). The control unit 101 may refer to a table shown on Table 2, for example, as the table of the lubricant supply operation execution interval.

TABLE 2

| | Remaining toner amount | | | |
|---|---|---|---|---|
| | 100% to 80% | Less than 80% to 60% | Less than 60% to 40% | Less than 40% to 0% |
| Yellow | Every 50 sheets | Every 80 sheets | Every 100 sheets | Every 100 sheets |
| Magenta | Every 10 sheets | Every 30 sheets | Every 50 sheets | Every 100 sheets |
| Cyan | Every 30 sheets | Every 50 sheets | Every 80 sheets | Every 100 sheets |
| Black | Every 50 sheets | Every 80 sheets | Every 100 sheets | Every 100 sheets |

Table of Lubricant Supply Operation Execution Interval According to Second Embodiment When toner containing a large amount of positive external additive is used, a state in which the toner containing a large amount of the positive external additive is more likely to slip out from under the cleaning member and cause a cleaning defect may be created. To prevent this state from occurring, the execution interval of the lubricant supply operation is narrowed so that the toner containing the positive external additive is consumed more quickly. In so doing, the amount of remaining toner decreases, leading to a reduction in the amount of positive external additive contained in the toner, and therefore, when the toner is supplied to the photosensitive drum, the amount of positive external additive that slips out from under the cleaning member decreases, with the result that a superior cleaning performance can be maintained. Further, with the developing apparatus of this embodiment, the toner containing the positive external additive is consumed selectively, and therefore, as described above, the absolute amount of external additive contained in the toner decreases as the remaining amount of toner decreases, making it possible to widen the execution interval of the lubricant supply operation.

Table 3 shows lubricant supply operation execution intervals at which cleaning defects do not occur. When process cartridges with the remaining toner amounts shown below on Table 3, for example, are attached, the finally selected number of sheets at which to execute the lubricant supply operation is every 10 sheets.

TABLE 3

| | Remaining toner amount | Number of sheets at which lubricant supply operation executed |
|---|---|---|
| Yellow | 65% | Every 80 sheets |
| Magenta | 90% | Every 10 sheets |
| Cyan | 60% | Every 50 sheets |
| Black | 20% | Every 100 sheets |

In this embodiment, every 10 sheets, which is the smallest number of sheets at which to execute the lubricant supply operation, is selected, but instead, the lubricant supply operation may be executed at a different optimum number of sheets for each color. In this case, a timing at which to execute the lubricant supply operation may exist only in relation to magenta. At this time, the lubricant supply operation can be executed using 120 lines rather than 30 lines, i.e. a quarter of the 120 lines serving as the lubricant supply amount limit.

Third Embodiment

Next, a third embodiment of the present invention will be described. Note that description of parts already described in the second embodiment has been omitted.

Similarly to the second embodiment, the execution interval of the lubricant supply operation is set at the same numbers of sheets as those shown on Table 3. At this time, Table 4 shows the lubricant supply amount at each timing when 100 sheets are printed continuously.

TABLE 4

| | Number of continuous printed sheets | | | | | | | | | |
|---|---|---|---|---|---|---|---|---|---|---|
| | 10 pages | 20 pages | 30 pages | 40 pages | 50 pages | 60 pages | 70 pages | 80 pages | 90 pages | 100 pages |
| Yellow | 0 | 0 | 0 | 0 | 0 | 0 | 0 | 0 | 0 | 0 |
| Magenta | 30 | 30 | 30 | 30 | 30 | 30 | 30 | 30 | 30 | 30 |
| Cyan | 0 | 0 | 0 | 0 | 30 | 0 | 0 | 0 | 0 | 30 |
| Black | 0 | 0 | 0 | 0 | 0 | 0 | 0 | 0 | 0 | 30 |
| total | 30 | 30 | 30 | 30 | 60 | 30 | 30 | 30 | 30 | 90 |

Note that in this embodiment, magenta, for example, is envisaged as being particularly likely to cause cleaning defects, and it may therefore be considered preferable to secure a wider margin in relation to magenta to avoid cleaning defects. In this case, as shown below on Table 5, the number of lines can be modified for each color within a range (120 lines) not exceeding the lubricant supply amount limit.

TABLE 5

| | Number of continuous printed sheets | | | | | | | | | |
|---|---|---|---|---|---|---|---|---|---|---|
| | 10 pages | 20 pages | 30 pages | 40 pages | 50 pages | 60 pages | 70 pages | 80 pages | 90 pages | 100 pages |
| Yellow | 0 | 0 | 0 | 0 | 0 | 0 | 0 | 30 | 0 | 0 |
| Magenta | 120 | 120 | 120 | 120 | 90 | 120 | 120 | 90 | 120 | 60 |
| Cyan | 0 | 0 | 0 | 0 | 30 | 0 | 0 | 0 | 0 | 30 |
| Black | 0 | 0 | 0 | 0 | 0 | 0 | 0 | 0 | 0 | 30 |
| total | 120 | 120 | 120 | 120 | 120 | 120 | 120 | 120 | 120 | 120 |

The basic lubricant supply amount limit in the magenta process cartridge is set at 120 lines. Further, at timings when the lubricant supply operation is executed simultaneously in relation to the other colors, for example when the number of continuously printed sheets is 50 pages, 80 pages, and 100 pages, the required minimum of 30 lines is maintained in all colors except magenta. As a result, the remainder, which is acquired by subtracting the total number of lines used by the other colors from 120 lines, can be supplied to magenta.

More specifically, at the timing of 100 pages, it is necessary to supply 30 lines to each of cyan and black, and therefore 60 lines, which is acquired by subtracting 60 lines from 120 lines, can be used as the magenta supply amount.

Thus, the amount of developer supplied to the photosensitive drum from the developing unit during execution of the lubricant supply operation can be modified in relation to each of the image forming units.

The lubricant supply operation is executed within a range not exceeding the lubricant supply amount limit, and therefore, by increasing the supply amount preferentially in relation to a photosensitive member apparatus that is difficult to clean, an improved cleaning performance can be maintained without causing soil on back surface of the paper.

Fourth Embodiment

Next, a fourth embodiment of the present invention will be described. Note that description of parts already described in the second embodiment has been omitted.

<Overall Configuration of Image Forming Apparatus>

Figure 10:
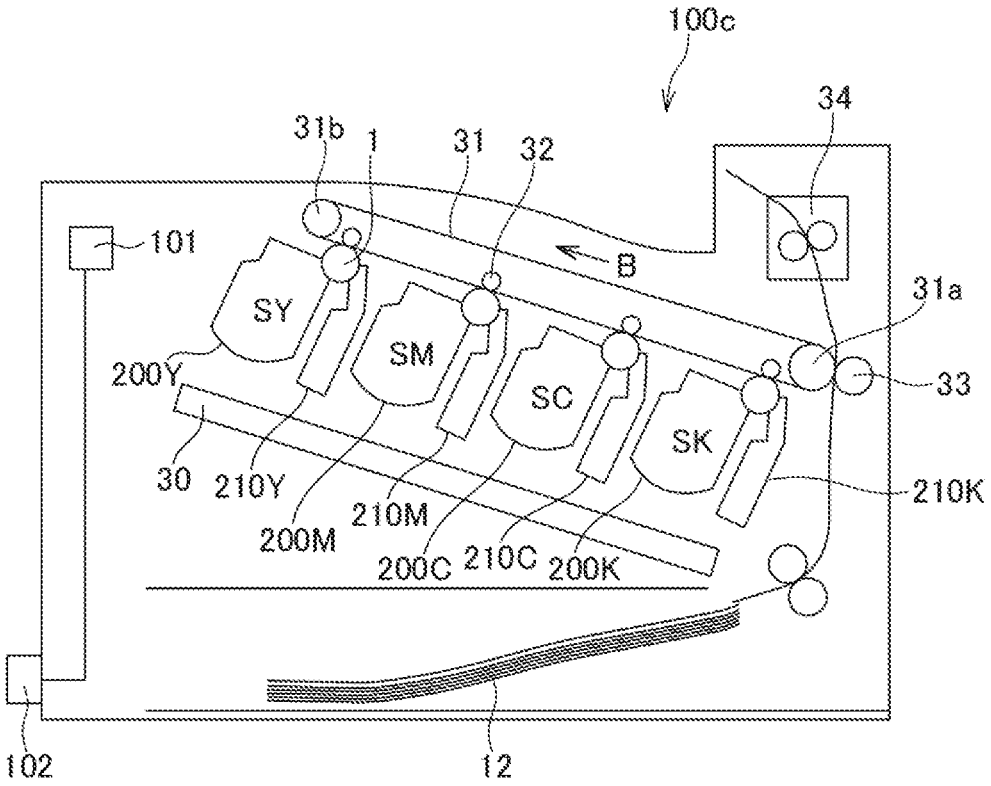
FIG. 10 is an illustrative view of an image forming apparatus according to a fourth embodiment.

FIG. 10 shows an image forming apparatus 100*c* according to this embodiment. In this embodiment, process cartridges such as those of the second embodiment are not used, and instead, two cartridges, namely the drum cartridge 210 and the developing cartridge 200, are used.

First, the drum cartridge 210 will be described.

Drum Cartridge

Figure 11:
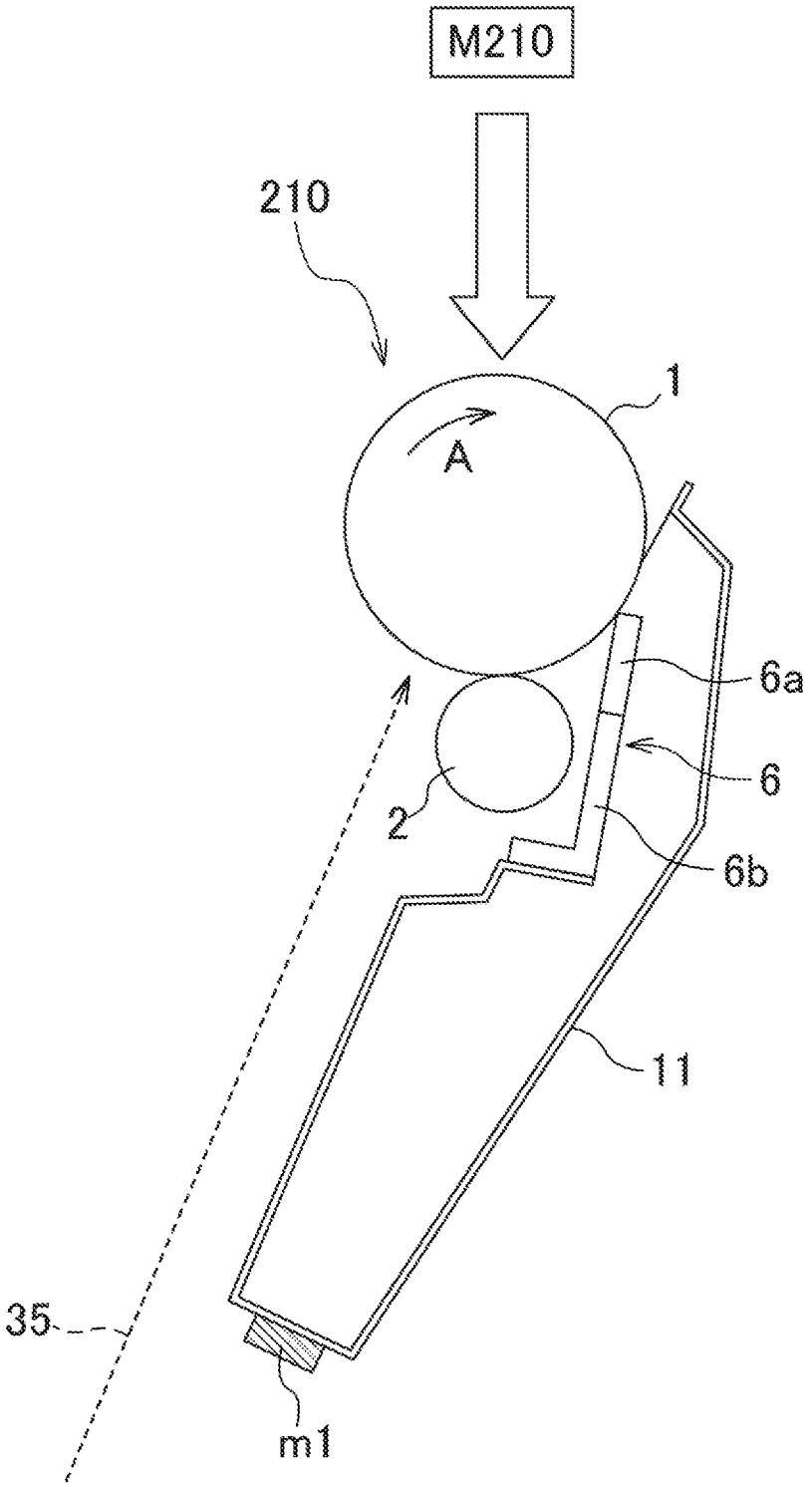
FIG. 11 is an illustrative view of a drum cartridge according to the fourth embodiment.

The drum cartridge 210 is realized by configuring the photosensitive member unit 13 of the second embodiment in the form of a cartridge. In other words, as shown in FIG. 11, the drum cartridge 210 is a cartridge including the photosensitive drum 1, the charging roller 2, and the cleaning blade 6. Further, a nonvolatile memory (referred to hereafter as the "O memory") m1 (a second storage unit) serving as a first memory is provided in the drum cartridge 210. Information corresponding to the use amount of the drum cartridge 210 is stored in the O memory m1.

Similarly to the second embodiment, the information corresponding to the use amount of the drum cartridge 210 is a value using the cumulative number of rotations or the cumulative rotation time of the photosensitive drum 1. Further, information (a serial number, a model, and so on) from which the type of the drum cartridge 210 can be specified is stored in the O memory m1. The control unit 101 is capable of acquiring an amount relating to use, such as the extent to which the drum cartridge 210 has been used or operated, on the basis of the information stored in the O memory m1. Note that the O memory m1 is configured to be capable of communicating (writing and reading information) with the control unit 101 of the image forming apparatus 100*c* shown in FIG. 10 either without contact or by contact through an electrical contact. Therefore, even when the drum cartridge 210 is temporarily detached from and then reattached to the apparatus main body of the image forming apparatus 100*c*, the control unit 101 can acquire the information corresponding to the use amount of the drum cartridge 210.

Next, the developing cartridge 200 will be described.

Developing Cartridge

Figure 12:
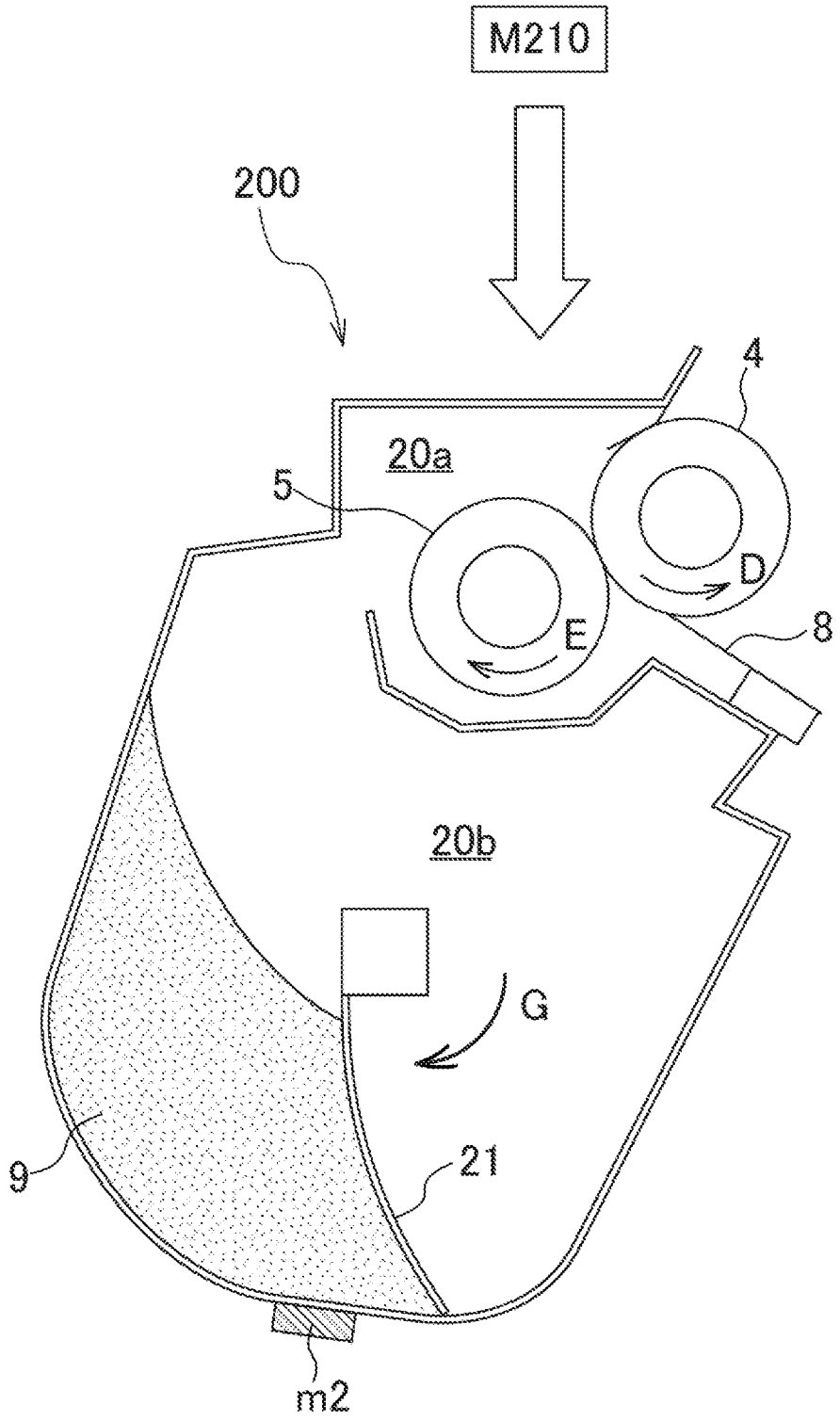
FIG. 12 an illustrative view of a developing cartridge according to the fourth embodiment.

The developing cartridge 200 is realized by configuring the developing unit 3 of the second embodiment in the form of a cartridge. In other words, as shown in FIG. 12, the developing cartridge 200 is constituted by the developing chamber 20*a* and the developer housing chamber 20*b*, and the toner 9 serving as the developer is housed in the developer housing chamber 20*b*. Together therewith, the developing cartridge 200 includes the developing roller 4, the supply roller 5, and the toner amount regulating member 8.

A nonvolatile memory (referred to hereafter as the "DT memory") m2 serving as a second memory is provided in the developing cartridge 200. Information corresponding to the use amount of the developing cartridge 200 is stored in the DT memory m2. Note that the information corresponding to the use amount of the developing cartridge 200, which serves as a developing apparatus, is stored in the DT memory m2, as described above, and therefore the DT memory m2 corresponds to the first storage unit of the second embodiment.

Similarly to the second embodiment, the information corresponding to the use amount of the developing cartridge 200 includes information such as the cumulative number of rotations of the developing roller 4, the cumulative rotation time of the developing roller 4, the toner use amount, and the remaining toner amount. The control unit 101 can acquire the information corresponding to the use amount of the developing cartridge 200 on the basis of the information stored in the DT memory m2. Note that the DT memory m2 is configured to be capable of communicating (writing and reading information) with the control unit 101 of the image forming apparatus 100 either without contact or by contact through an electrical contact. The control unit 101 may write the information corresponding to the use amount of the developing cartridge 200 to the DT memory m2, or a dedicated processor or the like provided in the apparatus main body of the image forming apparatus 100 may write the information corresponding to the use amount of the developing cartridge 200 to the DT memory m2. Thus, even when the developing cartridge 200 is temporarily detached from and then reattached to the apparatus main body of the image forming apparatus 100, the control unit 101 can acquire the information corresponding to the use amount of the developing cartridge 200.

In this embodiment, the outline of the lubricant supply operation and the lubricant supply amount limit are identical to the second embodiment.

Block Diagram

Figure 13:
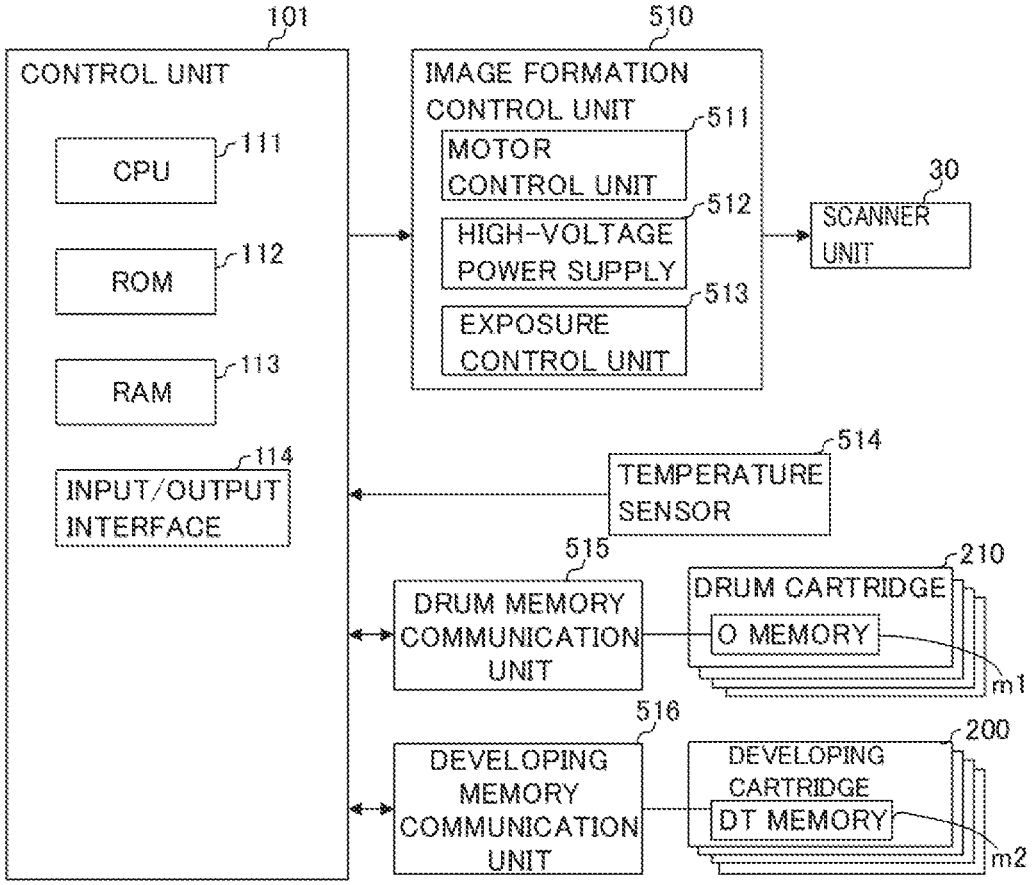
FIG. 13 is a control block diagram of the fourth embodiment.

Next, using FIG. 13, a control configuration of the image forming apparatus 100 will be described. FIG. 13 is a control block diagram of the fourth embodiment. Except for configurations relating to CRG memory communication units 515 and 516, FIG. 13 is identical to FIGS. 2 and 8, and therefore detailed description of the identical parts has been omitted. Here, only the configurations relating to the CRG memory communication units 515 and 516 will be described.

Data communication is performed between the control unit 101 and the O memory m1 via the drum memory communication unit 515, while data communication is performed between the control unit 101 and the DT memory m2 via the developing memory communication unit 516. The O memory m1 and the DT memory m2 are used when the control unit 101 determines the information relating to the use amounts of the drum cartridge 210 and the developing cartridge 200. The data stored in the DT memory m2 are transmitted to the control unit 101 through the developing memory communication unit 516. The control unit 101 determines a discharge timing during the periodic lubricant supply operation from information acquired from the environment sensor 515, the O memory m1, and the DT memory m2. Similar memories m1 and m2 are provided for the drum cartridges 210 and the developing cartridges 220 of the respective colors, and the control unit 101 acquires the required information from the memories m1 and m2 of the respective colors through the drum memory communication unit 515 and the developing memory communication unit 516.

The control unit 101 controls the execution interval of the lubricant supply operation for supplying the toner 9 to the photosensitive drum 1 from the developing roller 4 at a timing based on the information corresponding to the use amount of the drum cartridge 210 and the information corresponding to the use amount of the developing cartridge 200. Further, the control unit 101 controls the transmission and reception of various types of electric information signals, drive timings, and so on, and also administers the flowchart processing to be described below and so on. The control unit 101 counts the cumulative number of printed sheets following the start of use of the drum cartridge 210, the cumulative number of printed sheets following the start of use of the developing cartridge 200, and the cumulative number of printed sheets following the toner supply process, and stores the counted values of the cumulative numbers of printed sheets in the RAM 113. Counted values of the cumulative numbers of printed sheets may be stored in the RAM 113 in relation to each of the image forming units SY, SM, SC, SK.

Execution Processes of Lubricant Supply Operation

Figure 14:
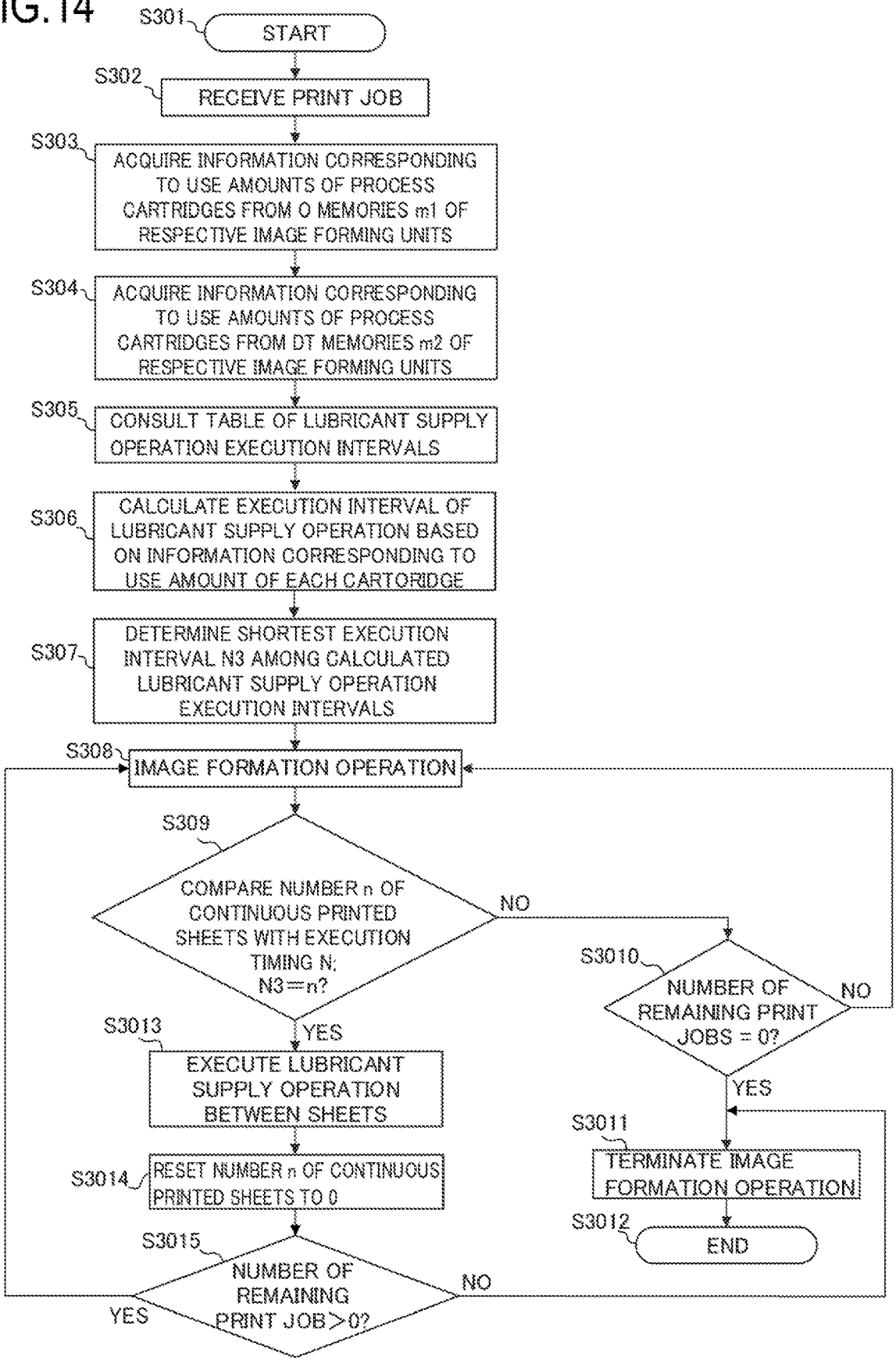
FIG. 14 is a flowchart for executing the lubricant supply operation according to the fourth embodiment.

Processes up to execution of the toner supply process according to the fourth embodiment will now be described using a flowchart shown in FIG. 14. When the image forming apparatus 100*c* enters an operable state after a power supply of the image forming apparatus 100*c* is switched ON or a cartridge exchange door is opened and closed, the flow shown in FIG. 14 is started (S301). First, the control unit 101 of the image forming apparatus receives, via the external interface 102, a print job transmitted from the host device over a communication line (S302). Next, the control unit 101 communicates with the O memory m1 installed in the drum cartridge 210 via the drum memory communication unit 515. As a result, the information corresponding to the use amount of the photosensitive member unit 13 and the use amount of the developing unit 3 is acquired from the O memories m1 of the respective image forming units SY, SM, SC, SK (S303). Next, the control unit 101 communicates with the DT memory m2 installed in the developing cartridge 200 via the developing memory communication unit 516. As a result, the information corresponding to the use amount of the developing cartridge 200 is acquired from the DT memories m2 of the respective image forming units SY, SM, SC, SK (S304).

Next, the control unit 101 reads and consults the table of execution intervals (numbers of printed sheets) of the lubricant supply operation from the ROM 112 (S305). The control unit 101 determines (calculates) the execution interval of the toner supply process individually for each of the image forming units SY, SM, SC, SK (S306). The control unit 101 then determines the shortest execution interval N3 among the execution intervals of the toner supply process, calculated for each of the image forming units SY, SM, SC, SK (S307).

Next, the image formation operation is started (S308). Once continuous printing has begun, the control unit 101 counts the number n of continuously printed sheets every time a sheet is printed and determines whether the number n matches the execution interval N3 (S309). Note that the term "every time a sheet is printed" has a similar meaning to the first and second embodiments, and therefore, in the case of double-sided printing, in which images are formed on both surfaces of a single sheet of paper, the number of counted sheets is 2.

When N3≠n, the control unit 101 checks whether or not the number of remaining print jobs=0 (S3010). When the number of remaining print jobs=0, the control unit 101 controls the image formation control unit 510 to terminate the image formation operation (S3011). The processing then advances to S3012, which is the end of the flowchart.

When, on the other hand, the number of remaining print jobs≠0 in S3010, the control unit 101 controls the image formation control unit 510 in order to start the next image formation operation (S308).

Returning to S309, when N3=n, the control unit 101 controls the image formation control unit 510 to execute the lubricant supply operation between sheets (S3013). The pattern of the toner image formed on the photosensitive drum 1 of each cartridge by the lubricant supply operation is similar to the first and second embodiments.

Next, the control unit 101 resets the value of the number n of continuous printed sheets to 0 (S3014) and then advances the processing to step S3015. In step S3015, the control unit 101 checks whether or not the number of remaining print jobs>0.

When the number of remaining print jobs>0, the control unit 101 advances the processing to the next image formation operation (S308). When, on the other hand, number of remaining print jobs>0 is not established, or in other words when the number of remaining print jobs is zero, the image formation operation is terminated (S3011).

The control unit 101 may refer to Table 2 used in the second embodiment and a table shown below on Table 6, for example, as the table of lubricant supply operation execution intervals.

From Table 6, the final execution timing of the lubricant supply operation may be determined according to the relationship between the number of sheets at the execution timing, determined from the information relating to the developing cartridge, and the lifespan of the drum. The reason for this is that as the remaining lifespan of the drum decreases, the surface of the photosensitive drum becomes more damaged, leading to deterioration of the cleaning performance, and to compensate for this deterioration, the execution frequency of the lubricant supply operation must be increased.

TABLE 6

| | | Drum lifespan | | |
|---|---|---|---|---|
| | | 100% to 40% | Less than 40% to 20% | Less than 20% to 0% |
| Execution timing determined from developing cartridge information | 10 sheets | Every 10 sheets | Every 8 sheets | Every 5 sheets |
| | 30 sheets | Every 30 sheets | Every 24 sheets | Every 15 sheets |
| | 50 sheets | Every 50 sheets | Every 40 sheets | Every 25 sheets |
| | 80 sheets | Every 80 sheets | Every 64 sheets | Every 40 sheets |
| | 100 sheets | Every 100 sheets | Every 80 sheets | Every 50 sheets |

Similarly to the second embodiment, Table 7 shows execution intervals of the lubricant supply operation at which cleaning defects do not occur. When developing cartridges such as those shown on Table 7, for example, are attached, the final numbers of sheets at which to execute the lubricant supply operation can be determined from the results shown on Table 6.

TABLE 7

| | Remaining toner amount | Number of sheets at which lubricant supply operation executed |
|---|---|---|
| Yellow | 65% | Every 80 sheets |
| Magenta | 90% | Every 10 sheets |
| Cyan | 60% | Every 50 sheets |
| Black | 20% | Every 100 sheets |

From the relationship between Table 7, which shows execution timings determined from the developing cartridge information, and Table 6, the final numbers of sheets at which to execute the lubricant supply operation are determined as shown on Table 8. When developing cartridges such as those shown below on Table 8, for example, are attached, the finally selected number of sheets at which to execute the lubricant supply operation is every 8 sheets.

TABLE 8

| | Drum lifespan | Number of sheets at which lubricant supply operation executed |
|---|---|---|
| Yellow | 55% | Every 80 sheets |
| Magenta | 40% | Every 8 sheets |
| Cyan | 30% | Every 40 sheets |
| Black | 10% | Eveiy 50 sheets |

In this embodiment, every 8 sheets, which is the smallest number of sheets at which to execute the lubricant supply operation, is selected, but instead, the lubricant supply operation may be executed at a different optimum number of sheets for each color. In this case, a timing at which to execute the lubricant supply operation may exist only in relation to magenta. At this time, the lubricant supply operation can be executed using 120 lines rather than 30 lines, i.e. a quarter of the 120 lines serving as the lubricant supply amount limit.

Further, as in the third embodiment, the number of lines may be modified for each color within a range not exceeding the lubricant supply amount limit.

Hence, the lubricant supply operation is executed in a range not exceeding the lubricant supply amount limit, and therefore, by increasing the supply amount preferentially in relation to a photosensitive member apparatus that is difficult to clean, an improved cleaning performance can be maintained without causing soil on back surface of the paper.

Therefore, according to the above disclosure, it is possible to provide an image forming apparatus with which a cleaning performance with respect to a photosensitive drum is maintained without causing a reduction in the productivity of image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-001490, filed on Jan. 8, 2019, which is hereby incorporated by reference herein in its entirety.

What is claimed is:

1. An image forming apparatus comprising:

a rotatable image bearing member on which an electrostatic latent image is formed;

a charging member for charging a surface of the image bearing member;

an exposure unit that forms the electrostatic latent image by exposing the surface of the image bearing member charged by the charging member;

a developing apparatus which, in order to form a developer image by developing the electrostatic latent image formed on the surface of the image bearing member, supplies a developer containing a toner particle and an external additive externally added to the toner particle, the external additive having an opposite charging polarity to a regular charging polarity of the toner particle, to the image bearing member;

a cleaning member that contacts the surface of the image bearing member in order to remove the developer from the surface of the image bearing member;

a transfer member provided facing the image bearing member in order to transfer the developer image formed on the surface of the image bearing member onto a transfer subject material; and a voltage application unit for applying a voltage to the transfer member, wherein, (i) the developing apparatus supplies the developer to the image bearing member during an image non-formation period of a continuous printing process and (ii) the voltage application unit applies a voltage having an identical polarity to a voltage applied during the image formation operation for transferring the developer image onto the transfer subject material during the image non-formation period, the image non-formation period corresponding to a timing between page-unit image formation operations and serves as a lubrication operation for supplying a lubricant to the cleaning member.

2. The image forming apparatus according to claim 1, wherein, the image non-formation period in which the developer image is not transferred onto the transfer subject material includes a first image non-formation period in which the lubrication operation is executed on the cleaning member and a second image non-formation period in which the lubrication operation is not executed on the cleaning member, and an execution interval of the lubrication operation is determined according to a length of the second image non-formation period following the first image non-formation period, wherein the image forming apparatus further comprises:

a first storage unit for storing information corresponding to a use amount of the developing apparatus; and a control unit for controlling the execution interval of the lubrication operation, and wherein the control unit controls the execution interval of the lubrication operation on the basis of the information corresponding to the use amount of the developing apparatus, which is read from the first storage unit.

3. The image forming apparatus according to claim 2, wherein the control unit executes control on the basis of information relating to a remaining amount of the developer which is included in the information corresponding to the use amount of the developing apparatus, so as to widen the execution interval of the lubrication operation as the remaining amount of the developer housed in a developer housing chamber decreases.

4. The image forming apparatus according to claim 3, further comprising a second storage unit for storing information relating to a use amount of the image bearing member, wherein the control unit determines the execution interval of the lubrication operation using the information corresponding to the use amount of the image bearing member which has been read from the second storage unit.

5. The image forming apparatus according to claim 2, further comprising a second storage unit for storing information relating to a use amount of the image bearing member, wherein the control unit determines the execution interval of the lubrication operation using the information corresponding to the use amount of the image bearing member which has been read from the second storage unit.

6. The image forming apparatus according to claim 5, wherein a drum cartridge is formed from the image bearing member, the charging member, and the cleaning member, and the second storage unit is provided in the drum cartridge.

7. The image forming apparatus according to claim 2, wherein the developing apparatus is a cartridge that capable of being attached to and detached from an apparatus main body of the image forming apparatus, and wherein the first storage unit is provided in the cartridge.

8. The image forming apparatus according to claim 1, further comprising a plurality of image forming units, each of which includes the image bearing member, the developing apparatus, the cleaning member, and the transfer member, wherein an amount of developer supplied to the image bearing member from the developing apparatus is capable of being modified individually for each of the plurality of image forming units.

9. The image forming apparatus according to claim 1, wherein a limit amount of the developer capable of being supplied to the image bearing member from the developing apparatus during a single execution of the lubrication operation is predetermined in advance.

10. The image forming apparatus according to claim 1, wherein a metal or a metal oxide is used as the external additive.

* * * * *